US006082345A

United States Patent [19]

Ikeuchi et al.

[11] Patent Number: 6,082,345

[45] Date of Patent: Jul. 4, 2000

[54] AIR-FUEL RATIO CONTROL SYSTEM FOR INTERNAL COMBUSTION ENGINES

[75] Inventors: Kota Ikeuchi; Norio Suzuki; Yukio Noda, all of Wako, Japan

[73] Assignee: Honda Giken Kogyo Kabushiki Kaisha, Tokyo, Japan

[21] Appl. No.: 09/195,441

[22] Filed: Nov. 18, 1998

[30] Foreign Application Priority Data

Dec. 5, 1997 [JP] Japan ..... 9-350200

[51] Int. Cl.[7] ..... F02D 41/00

[52] U.S. Cl. ..... 123/689; 123/688

[58] Field of Search ..... 123/688, 689, 123/693, 272, 690, 697; 73/23.32

[56] References Cited

U.S. PATENT DOCUMENTS

| | | | |
|---|---|---|---|
| 4,505,246 | 3/1985 | Nakajima et al. | 123/489 |
| 5,483,946 | 1/1996 | Hamburg et al. | 123/686 |
| 5,656,190 | 8/1997 | Aoki | 219/505 |
| 5,709,198 | 1/1998 | Sagisaka et al. | 123/684 |
| 5,852,228 | 12/1998 | Yamashita et al. | 73/23.32 |

FOREIGN PATENT DOCUMENTS

| | | |
|---|---|---|
| 59-163556 | 9/1984 | Japan . |
| 4-203233 | 7/1992 | Japan . |

*Primary Examiner*—Henry C. Yuen
*Assistant Examiner*—Mahmoud M. Gimie
*Attorney, Agent, or Firm*—Arent, Fox, Kintner, Plotkin & Kahn

[57] ABSTRACT

An air-fuel ratio control system for an internal combustion engine is provided, which includes an oxygen concentration sensor arranged in the exhaust system and having an output characteristic that an output thereof is substantially proportional to concentration of oxygen present in exhaust gases from the engine. An ECU is responsive to the output of the oxygen concentration sensor, for carrying out feedback control of the air-fuel ratio of a mixture supplied to the engine so as to make the air-fuel ratio equal to a desired air-fuel ratio. An activated state of the oxygen concentration sensor is detected. Correction of the air-fuel ratio of the mixture by the feedback control is limited, depending upon the detected activated state of the oxygen concentration sensor.

9 Claims, 15 Drawing Sheets

FUEL INJECTION VALVE
6
INTERNAL COMBUSTION ENGINE
1
2
3
3'
θTH
4
PBA
7
8
TA
9
TW
10
NE
11
CYL
12
13
LAF
15
25
16
THREE-WAY CATALYST
14
5
5a
5b
5c
5d
INPUT CIRCUIT
CPU
MEMORY MEANS
OUTPUT CORCIOT
ECU
EL. VALVE
17
POIL
18

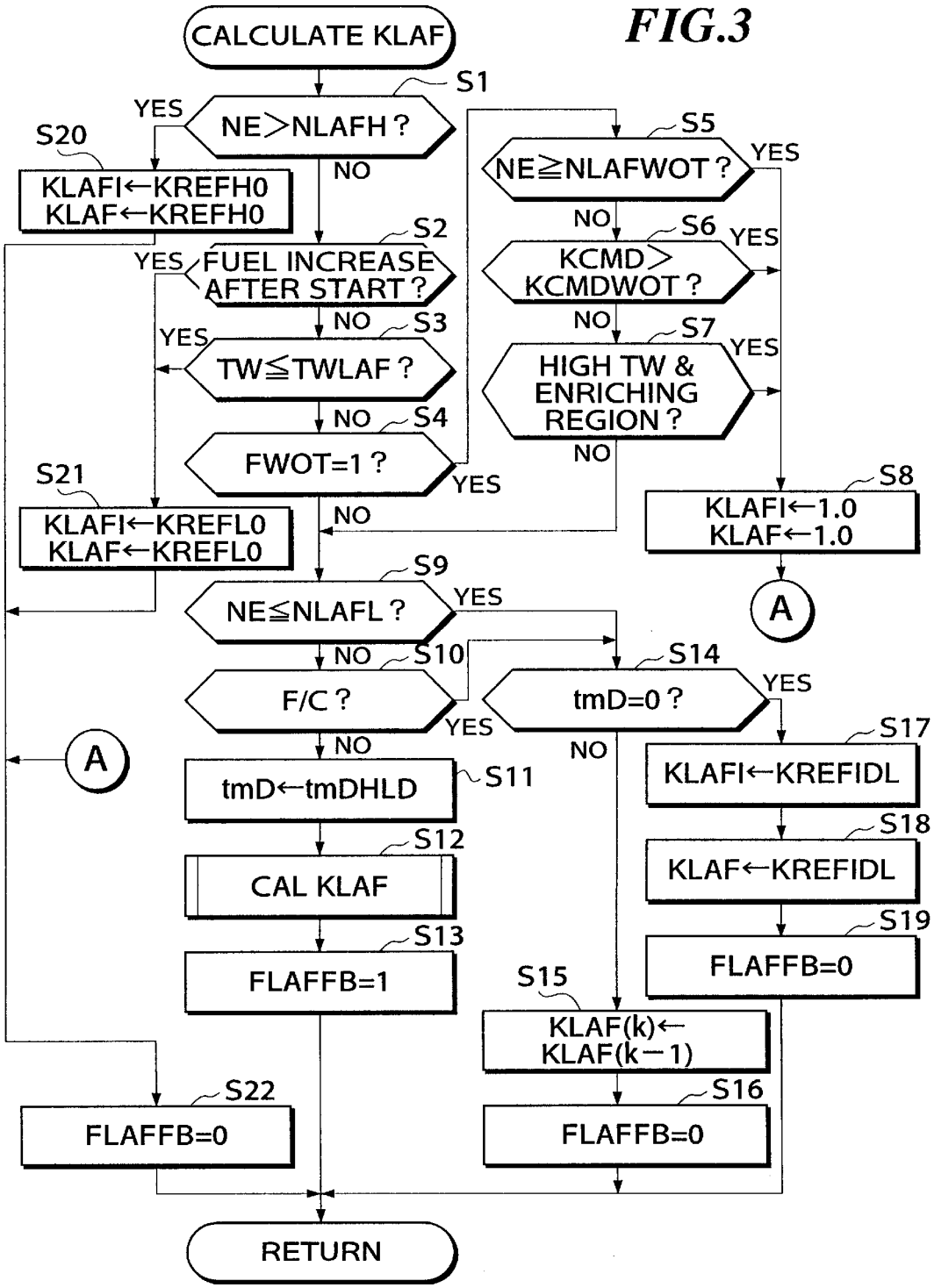
FIG.3
CALCULATE KLAF
S1
NE>NLAFH ?
YES
NO
S20
KLAFI←KREFH0
KLAF←KREFH0
S2
FUEL INCREASE AFTER START ?
YES
NO
S3
TW≦TWLAF ?
YES
NO
S4
FWOT=1 ?
YES
NO
S21
KLAFI←KREFL0
KLAF←KREFL0
S9
NE≦NLAFL ?
YES
NO
S10
F/C ?
YES
NO
S11
tmD←tmDHLD
S12
CAL KLAF
S13
FLAFFB=1
S22
FLAFFB=0
A
S5
NE≧NLAFWOT ?
YES
NO
S6
KCMD> KCMDWOT ?
YES
NO
S7
HIGH TW & ENRICHING REGION ?
YES
NO
S8
KLAFI←1.0
KLAF←1.0
A
S14
tmD=0 ?
YES
NO
S17
KLAFI←KREFIDL
S18
KLAF←KREFIDL
S19
FLAFFB=0
S15
KLAF(k)← KLAF(k−1)
S16
FLAFFB=0
RETURN

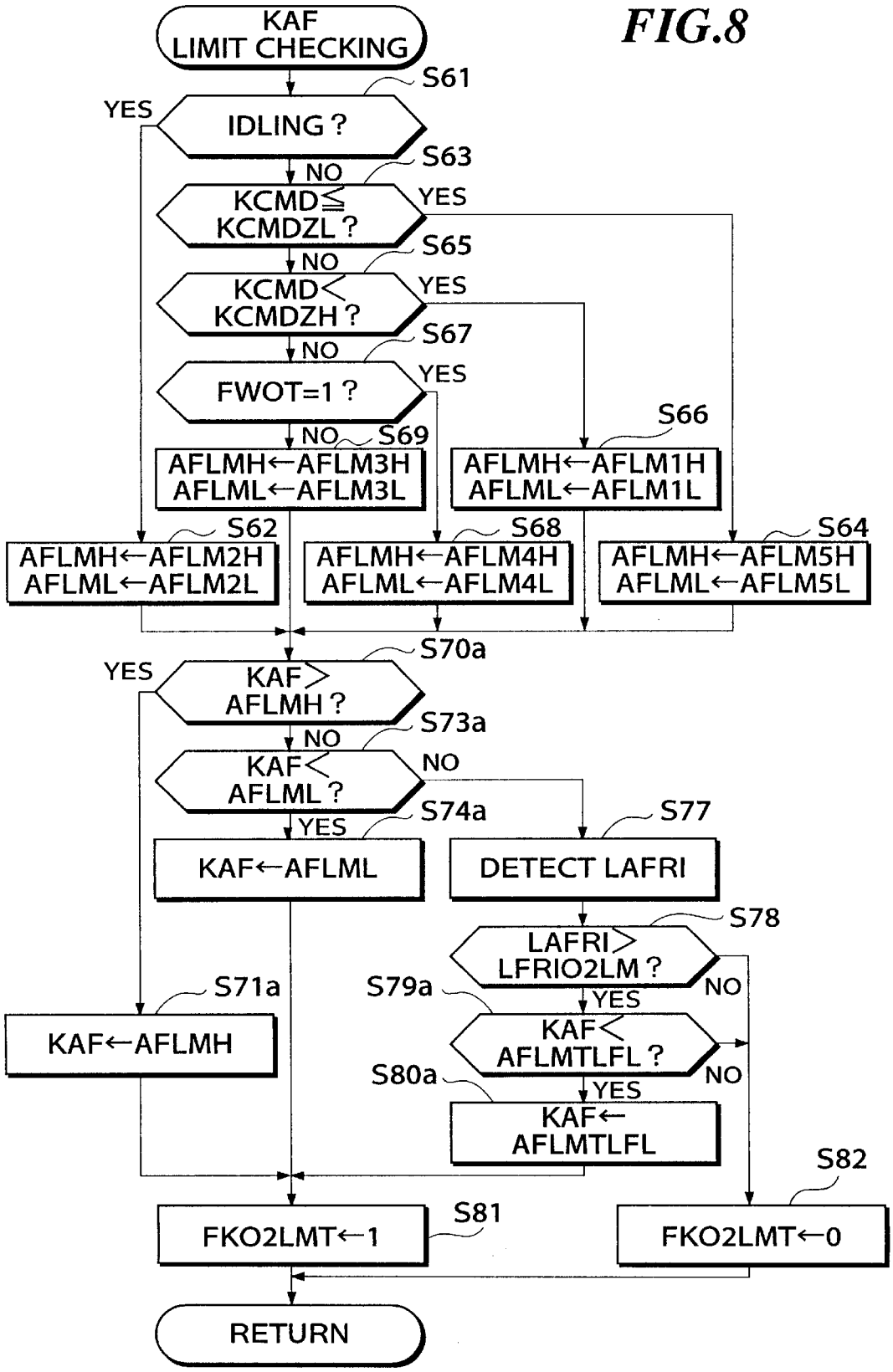
FIG.8
KAF LIMIT CHECKING
S61
IDLING ?
YES
NO
S63
KCMD≦ KCMDZL ?
YES
NO
S65
KCMD< KCMDZH ?
YES
NO
S67
FWOT=1 ?
YES
NO
S69
AFLMH←AFLM3H AFLML←AFLM3L
S66
AFLMH←AFLM1H AFLML←AFLM1L
S62
AFLMH←AFLM2H AFLML←AFLM2L
S68
AFLMH←AFLM4H AFLML←AFLM4L
S64
AFLMH←AFLM5H AFLML←AFLM5L
S70a
KAF> AFLMH ?
YES
NO
S73a
KAF< AFLML ?
NO
YES
S74a
KAF←AFLML
S77
DETECT LAFRI
S78
LAFRI> LFRIO2LM ?
NO
YES
S79a
KAF< AFLMTLFL ?
NO
YES
S80a
KAF← AFLMTLFL
S71a
KAF←AFLMH
S81
FKO2LMT←1
S82
FKO2LMT←0
RETURN

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which carries out feedback control of the air-fuel ratio of a mixture supplied to the engine, in response to an output from an oxygen concentration sensor having output characteristics substantially proportional to oxygen concentration in exhaust gases from the engine.

2. Prior Art

A limiting current type oxygen concentration sensor generally employed in air-fuel ratio control systems for internal combustion engines has an output characteristic that an output current value thereof is proportional to partial pressure of oxygen in exhaust gases from the engine when a positive voltage is applied to the sensor. There has been already known an oxygen concentration detecting system which utilizes such output characteristic of the limiting current type oxygen concentration sensor to linearly detect the oxygen concentration in exhaust gases from an internal combustion engine (Japanese Laid-Open Patent Publication (Kokai) No. 59-163556). Limiting current characteristics of an oxygen concentration sensor of this type change with the temperature of the sensor, and therefore the temperature of the sensor must always be controlled within a predetermined activation temperature range so as to maintain required detection accuracy. The known oxygen concentration detecting system, therefore, detects the internal resistance of the oxygen concentration sensor assumed when a predetermined negative voltage is applied to the sensor and (controls heating of the sensor by means of a heater so that the detected internal resistance value is held constant to thereby maintain the sensor in an activated state, utilizing the nature of the oxygen concentration sensor that the output current from the sensor assume, a value proportional to the temperature of the sensor independently of the oxygen partial pressure when a negative voltage is applied to the sensor.

An air-fuel ratio control method for internal combustion engines using an oxygen concentration sensor of this type has been disclosed by Japanese Laid-Open Patent Publication (Kokai) No. 4-203233, which includes calculating an amount of fuel to be supplied to the engine using an air-fuel ratio correction coefficient set based on an output from the oxygen concentration sensor and a desired air-fuel ratio to feedback-control the air-fuel ratio of a mixture supplied to the engine to the desired air-fuel ratio, and setting upper and lower limits of the air-fuel ratio correction coefficient according to the desired air-fuel ratio so as to prevent excessive correction of the air-fuel ratio, thereby feedback-controlling the air-fuel ratio within a proper range.

On the other hand, with recent stricter regulation of exhaust gases, there is an increasing demand for starting the feedback control of the air-fuel ratio as early as possible after the start of the engine, and hence it is desired that the oxygen concentration sensor should become activated as early as possible after the start of the engine. Conventionally, to promote activation of the sensor, the sensor is heated by means of a heater. However, the sensor cannot be heated to the activation temperature instantly after the start of heating. Thus, immediately after the start of the engine, the oxygen concentration sensor is not fully activated, and therefore, until the sensor becomes fully activated, exhaust gases from the engine contain considerable amounts of unburnt HC and sulfur components and hence are in an unstable or unpurified condition.

If the air-fuel ratio feedback control is started at early timing after the start of the engine, using the above-mentioned conventional air-fuel ratio method which sets upper and lower limits of the air-fuel ratio correction coefficient irrespective of the activation state of the oxygen concentration sensor, the output from the oxygen concentration sensor can deviate to a richer side from a proper value, leading to inaccurate detection of the oxygen concentration. Consequently, an inappropriate amount of fuel can be supplied to the engine, which causes hesitation of the engine operation and degraded exhaust emission characteristics.

SUMMARY OF THE INVENTION

It is the object of the invention to provide an air-fuel ratio control system for internal combustion engines, which is capable of carrying out air-fuel ratio feedback control so as to maintain the air-fuel ratio within a proper range even in the event that the output from the oxygen concentration sensor deviates from a proper value, leading to inaccurate detection of the oxygen concentration (air-fuel ratio) when the oxygen concentration sensor is not fully activated.

To attain the above object, according to a first aspect of the present invention, there is provided an air-fuel ratio control system for an internal combustion engine having an exhaust system, including an oxygen concentration sensor arranged in the exhaust system, the oxygen concentration sensor having an output characteristic that an output thereof is substantially proportional to concentration of oxygen present in exhaust gases from the engine, and feedback control means responsive to the output of the oxygen concentration sensor, for carrying out feedback control of an air-fuel ratio of a mixture supplied to the engine so as to make the air-fuel ratio equal to a desired air-fuel ratio.

The air-fuel ratio control system according to the first aspect of the invention is characterized by comprising:

activated state-detecting means for detecting an activated state of the oxygen concentration sensor; and correction-limiting means for limiting correction of the air-fuel ratio of the mixture by the feedback control means, depending upon the activated state of the oxygen concentration sensor detected by the activated state-detecting means.

Preferably, the activated state-detecting means comprises internal resistance-detecting means for detecting internal resistance of the oxygen concentration sensor.

Further preferably, the correction-limiting means sets a lower limit value of an amount of correction of the air-fuel ratio of the mixture to a larger value and/or sets an upper limit value of the amount of correction to a smaller value when the internal resistance of the oxygen concentration sensor detected by the internal resistance-detecting means is higher than a value of the internal resistance to be assumed when the oxygen concentration sensor has a temperature thereof falling in a predetermined activation temperature range within which the oxygen concentration sensor can be activated.

Alternatively, the correction-limiting means sets a feedback gain applied to the feedback control to a smaller value when the internal resistance of the oxygen concentration sensor detected by the internal resistance-detecting means is higher than a value of the internal resistance to be assumed when the oxygen concentration sensor has a temperature thereof falling in a predetermined activation temperature ranges within which the oxygen concentration sensor can be activated.

Further alternatively, the feedback control means calculates an amount of correction of the air-fuel ratio of the mixture in response to a difference between a detected air-fuel ratio obtained from the output from the oxygen concentration sensor and the desired air-fuel ratio, the correction-limiting means limiting the difference within a predetermined range when the internal resistance of the oxygen concentration sensor detected by the internal resistance-detecting means is higher than a value of the internal resistance to be assumed when the oxygen concentration sensor has a temperature thereof falling in a predetermined activation temperature range within which the oxygen concentration sensor can be activated.

To attain the above object, according to a second aspect of the present invention, there is provided an air-fuel ratio control system for an internal combustion engine having an exhaust system, including an oxygen concentration sensor arranged in the exhaust system, the oxygen concentration sensor having an output characteristic that an output thereof is substantially proportional to concentration of oxygen present in exhaust gases from the engine, feedback control means responsive to the output of the oxygen concentration sensor, for carrying out feedback control of an air-fuel ratio of a mixture supplied to the engine so as to make the air-fuel ratio of the mixture equal to a desired air-fuel ratio by calculating an air-fuel ratio correction coefficient, adaptive control means for carrying out adaptive control of the air-fuel ratio of said mixture so as to make the air-fuel ratio of the mixture equal to the desired air-fuel ratio by calculating an adaptive correction coefficient, and selecting means for selecting one of the feedback control means and the adaptive control means and applying a corresponding one of the air-fuel ratio correction coefficient and the adaptive correction coefficient to the selected one of the feedback control means and the adaptive control means as a feedback correction coefficient for correcting the air-fuel ratio of the mixture.

The air-fuel ratio control system according to the second aspect of the invention is characterized by comprising:

activated state-detecting means for detecting an activated state of the oxygen concentration sensor; and inhibiting means for inhibiting the adaptive control means from being selected by the selecting means, depending upon a value of the feedback correction coefficient and the activated state of the oxygen concentration sensor detected by the activated state-detecting means.

Preferably, the inhibiting means inhibits the adaptive control means from being selected when the feedback correction coefficient has a value thereof falling outside a predetermined range and at the same time the oxygen concentration sensor is not in an activated state.

The above and other objects, features, and advantages of the invention will become more apparent from the following detailed description taken in conjunction with the accompanying drawings.

BRIEF DESCRIPTION OF THE DRAWINGS

FIG. 3 is a flowchart of a program for calculating an air-fuel ratio correction coefficient KLAF;

FIG. 8 is a flowchart of a subroutine for carrying out limit checking of the correction coefficient KLAF, which is executed at steps S208 and S214 of FIG. 6B;

DETAILED DESCRIPTION

The invention will now be described in detail with reference to the drawings showing embodiments thereof.

Figure 1:
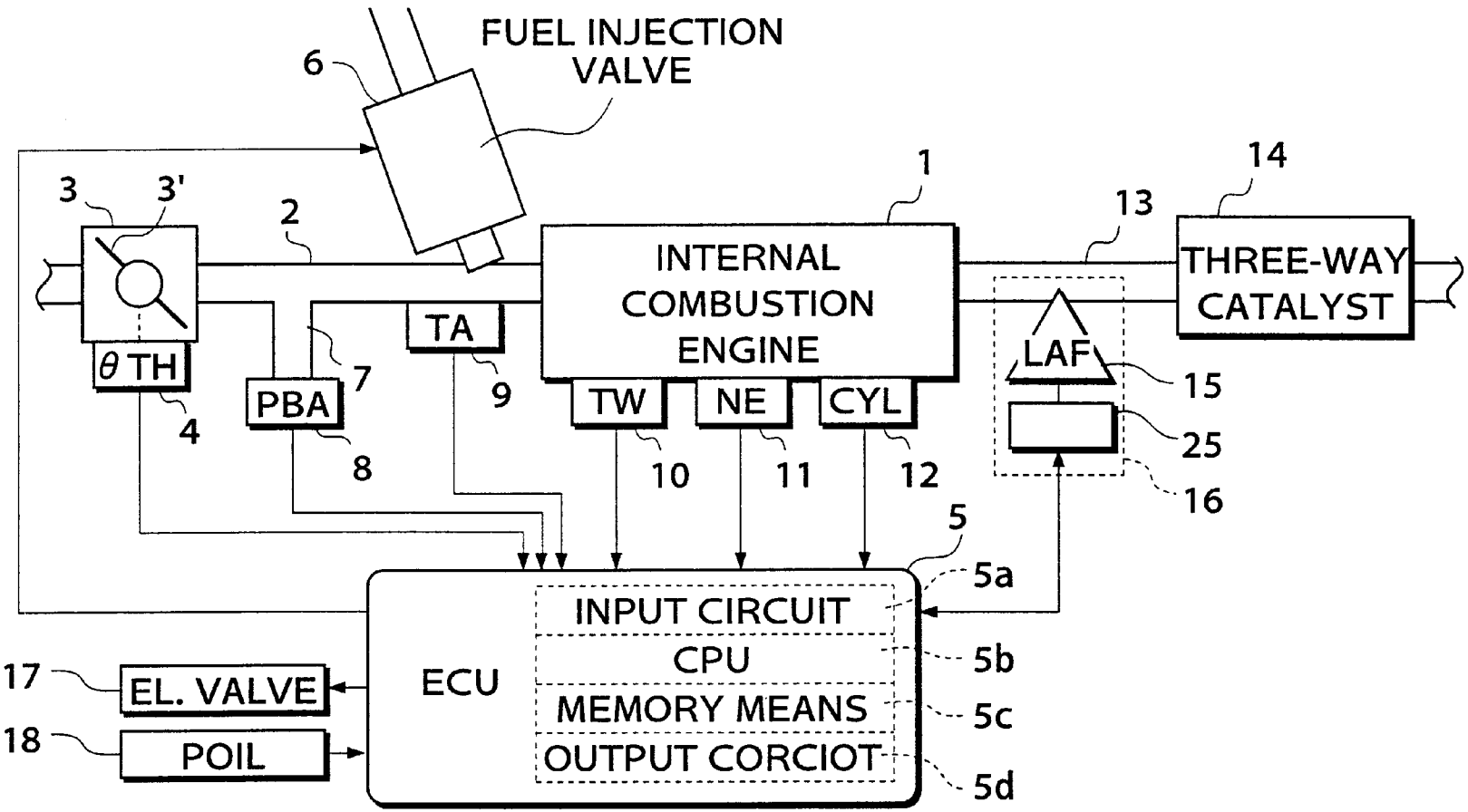
FIG. 1 is a block diagram showing the arrangement of an internal combustion engine and a control system therefor, including an air-fuel ratio control system according to a first embodiment of the invention.

Referring first to FIG. 1, there is schematically shown the whole arrangement of an internal combustion engine and a control system therefor, including an air-fuel ratio control system according to a first embodiment of the invention. In the Figure, reference numeral 1 designates a four-cylinder type DOHC in-line internal combustion engine (hereinafter simply referred to as "the engine"). The engine 1 is adapted to have operating characteristics (i.e. valve opening timing and lift amount) of intake valves and exhaust valves thereof switched between a high speed valve timing suitable for operation of the engine in a high speed operating region thereof and a low speed valve timing suitable for operation of the engine in a low speed operating region thereof.

The engine 1 has an intake pipe 2, across which is arranged a throttle body 3 accommodating a throttle valve 3'. A throttle valve opening (θ TH) sensor 4 is connected to the throttle valve 3', for generating an electric signal indicative of the sensed throttle valve opening θ TH and supplying the same to an electronic control unit (hereinafter referred to as "the ECU") 5.

Fuel injection valves 6 are inserted into the intake pipe 2 for respective cylinders at locations intermediate between the cylinder block of the engine 1 and the throttle valve 3' and slightly upstream of the intake valves, not shown. The fuel injection valves 6 are connected to a fuel pump, not shown, and electrically connected to the ECU 5 to have the fuel injection periods (valve opening periods) thereof controlled by signals therefrom.

An electromagnetic valve 17 which changes valve timing of the intake valves out of the the intake valves and exhaust valves, not shown, is electrically connected to the output side of the ECU 5, to have operation thereof controlled by a signal from the ECU 5. The electromagnetic valve 17 changes a hydraulic pressure supplied to a timing changeover mechanism, not shown, between a high value and a low value such that the mechanism operates in response to the hydraulic pressure to change the valve timing between the high speed valve timing and the low speed valve timing. The hydraulic pressure within the valve timing changeover mechanism is sensed by a hydraulic pressure (POIL) sensor 18, which is electrically connected to the ECU 5, to supply a signal indicative of the sensed hydraulic pressure to the ECU 5 which in turn controls the electromagnetic valve 17 in response to the signal.

An intake pipe absolute pressure (PBA) sensor 8 is provided in communication with the interior of the intake pipe 2 at a location immediately downstream of the throttle valve 3' through a conduit 7. The PBA sensor 8 is electrically connected to the ECU 5, for supplying a signal indicative of the sensed intake pipe absolute pressure PBA to the ECU 5. An intake air temperature (TA) sensor 9 is inserted into the intake pipe 2 at a location downstream of the {PBA) sensor 8, for supplying an electric signal indicative of the sensed intake air temperature TA to the ECU 5.

An engine coolant temperature (TW) sensor 10, which may be formed of a thermistor or the like, is mounted in the cylinder block of the engine 1 filled with an engine coolant, for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the cylinder-discriminating sensor 12 generates a signal pulse (hereinafter referred to as "a CYL signal pulse") at a predetermined crank angle of a particular cylinder of the engine 1. Signal pulses generated by these sensors are supplied to the ECU 5.

A three-way catalyst 14 is arranged in an exhaust pipe 14 of the engine 1, for purifying noxious components present in exhaust gases, such as HC, CO, and NOx. A limiting current type oxygen concentration sensor (hereinafter referred to as "the LAF sensor") 15 is arranged in the exhaust pipe 14 at a location upstream of the three-way catalyst 14.

The LAF sensor 15 constitutes an oxygen concentration-detecting device 16 together with an oxygen concentration detecting/activation control device (hereinafter referred to as "control device") 25 as internal resistance-detecting means. The LAF sensor 15 is electrically connected through the control device 25 to the ECU 5, such that the sensor 15 supplies the control device 25 with an electric signal substantially proportional in value to the concentration of oxygen present in exhaust gases from the engine (i.e. the air-fuel ratio), and values of the oxygen concentration thus stored in the control device 25 are read out by the ECU 5.

The ECU 5 is comprised of an input circuit 5*a* having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as "the CPU") 5*b*, a memory circuit 5*c* storing various operational programs which are executed by the CPU, referred to hereinafter, and for storing results of calculations from the CPU, etc., and an output circuit 5*d* which outputs driving signals to the fuel injection valves 6 and electromagnetic valve 21, etc.

The CPU 5*b* operates in response to the above-mentioned signals from the sensors to determine operating conditions in which the engine 1 is operating, such as an air-fuel ratio feedback control region in which air-fuel ratio feedback control is carried out in response to outputs from the LAF sensor 15, and air-fuel ratio open-loop control regions, and calculates, based upon the determined engine operating conditions, the fuel injection period TOUT over which the fuel injection valves 6 are to be opened, by the use of the following equation (1), in synchronism with TDC signal pulses, to output signals for driving the fuel injection valves 6, based on results of the calculation:

$$TOUT=Ti\times KCMDM\times KLAF\times K1+K2 \quad (1)$$

where Ti represents a basic value of the fuel injection amount TOUT, more specifically, a basic fuel injection period determined according to the engine rotational speed NE and the intake pipe absolute pressure PBA by a Ti map stored in the memory means 5*c*.

KCMDM represents a modified desired air-fuel ratio coefficient, which is set by multiplying a desired air-fuel ratio coefficient KCMD determined based on operating conditions of the engine, by a fuel cooling correction coefficient KETV. The fuel cooling correction coefficient KETV is for correcting in advance the fuel injection amount to compensate for a change in the air-fuel ratio of a mixture supplied to the engine 1 due to a cooling effect of fuel actually injected into the intake pipe 2, and set according to the desired air-fuel ratio coefficient KCMD. As will be understood from the equation (1), as the desired air-fuel ratio coefficient KCMD increases, the fuel injection period (fuel injection amount) increases, and therefore the coefficients KCMD and KCMDM assume values proportional to the reciprocal of the air-fuel ratio A/F. The desired air-fuel ratio coefficient KCMD assumes a value proportional to the reciprocal of the air-fuel ratio, i.e. the fuel-air ratio F/A, and assumes a value of 1.0 when the air-fuel ratio is equal to a stoichiometric value and hence is called "desired equivalent ratio".

KLAF represents an air-fuel ratio correction coefficient, which is calculated by a program of FIGS. 3A and 3B, hereinafter described, and set during the air-fuel ratio feedback control such that the air-fuel ratio detected by the LAF sensor 15 becomes equal to a desired air-fuel ratio set by the KCMDM value, and set during the open-loop control to predetermined values depending on operating conditions of the engine.

K1 and K2 represent other correction coefficients and correction variables, respectively, which are set depending on operating conditions of the engine to such values as will optimize operating characteristics of the engine, such as fuel consumption and engine accelerability.

The CPU 5*b* further carries out control of opening and closing the electromagnetic valve 17 in response to operating conditions of the engine 1 by generating a valve timing changeover command to the valve.

The CPU 5*b* outputs driving signals based on results of the above calculations and determinations to the fuel injection valves 6 and the electromagnetic valve 17, via the output circuit 5*d*.

Figure 2:
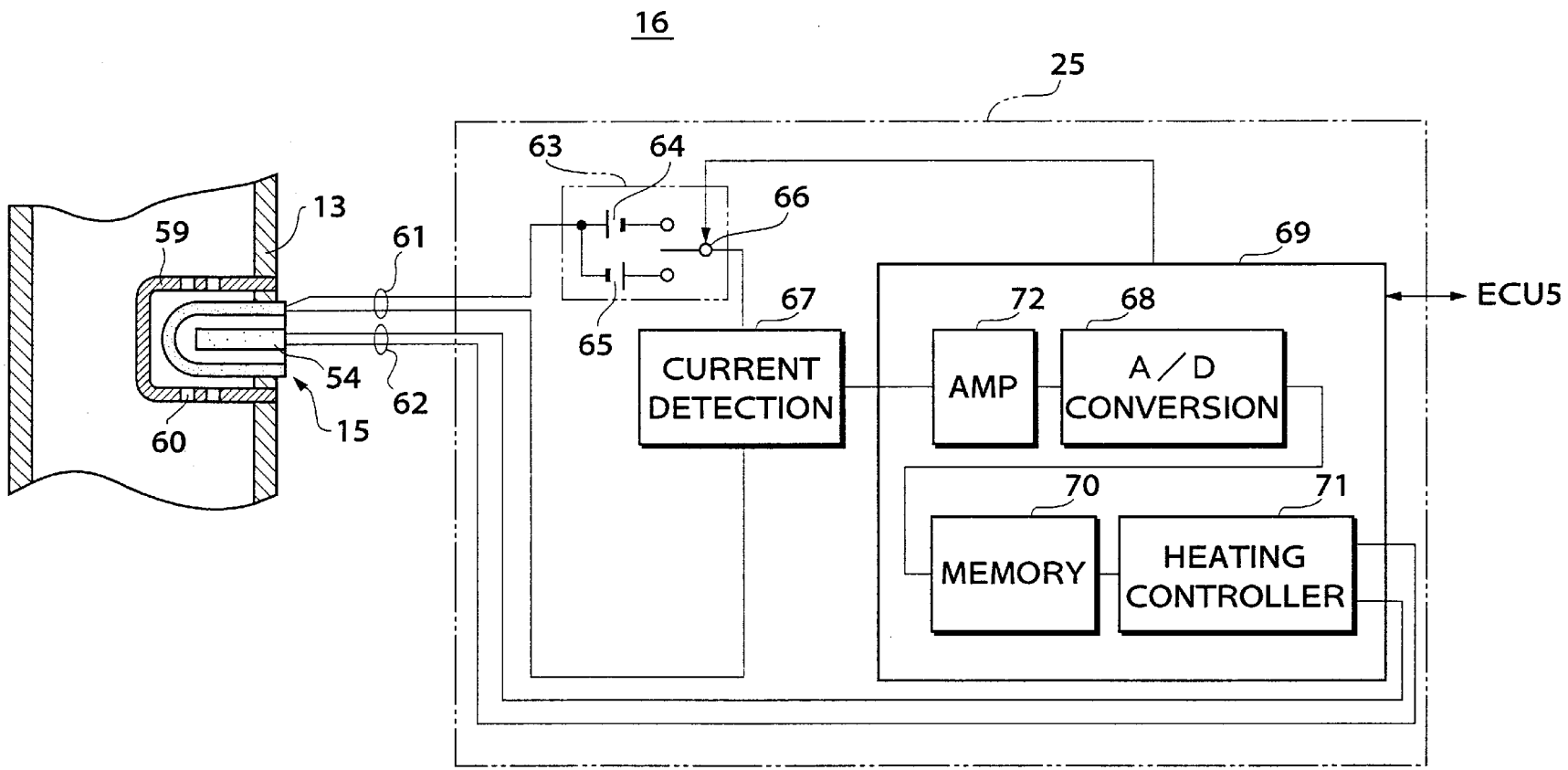
FIG. 2 is a block diagram showing details of the construction of an oxygen concentration-detecting device 15 appearing in FIG. 1.

FIG. 2 shows in details the construction of the oxygen concentration-detecting device 16 appearing in FIG. 1. In the Figure , corresponding elements to those in FIG. 1 are designated by identical reference numerals. The oxygen concentration-detecting device 16 is comprised of the LAF sensor 15, and the control device 25. The LAF sensor 15 is inserted into the exhaust pipe 13 of the engine 2, as stated above, which has an output signal line thereof detachably connected to the control device 25 by a connector, not shown. The LAF sensor 15 is comprised of a solid electrolyte element in the form of a cup, and so forth, with a heater 54 mounted therein. The heater 54 has a sufficient heating capacity for activating the LAF sensor 15. Further, the LAF sensor 15 is enclosed within a cover 59 formed with small through holes 60 for permitting exhaust gases to flow into the cover 59, whereby the LAF sensor 15 is protected from being directly exposed to exhaust gases flowing in the exhaust pipe 13, with enhanced heat insulation of the LAF sensor 15.

On the other hand, the control device 25 is provided with a bias control block 63, a current-detecting block 67, and a control block 69. One of two lead wires 61 connected to the LAF sensor 15 is connected to the bias control block 63, whereas the other of the lead wires 61 is connected to the current-detecting block 67. Two lead wires 62 connected to the heater 54 are connected to a heating controller 71 of the control block 69.

The bias control block 63 has a positive bias source 64, a negative bias source 65, and a selector switch 66. The current-detecting block 67 is connected to the selector switch 66 and the control block 69, and the selector switch 66 is also connected to the control block 69. The selector switch 66 changes over the polarity of the bias voltage to be applied to the LAF sensor 15, in response to a signal from the control block 69. The current-detecting block 67 generates and delivers the detected current value to the control block 69.

The control block 69 is comprised of an amplifier 72 for amplifying and shaping a detected current signal from the current detecting block 67, an A/D convertor 68 for converting an analog signal from the amplifier 72 to a digital signal, a memory 70, and the heating controller 71 for controlling the heating of the heater 54. The memory 70 is comprised of a ROM and RAM storing various operational programs to be executed by the control block 69, hereinafter referred to, and maps and results of computations, and a ring buffer for storing a detected value of oxygen concentration (air-fuel ratio A/F).

The control block 69 receives the CYL signal pulse, TDC signal pulse, the engine rotational speed (NE) signal, and the intake pipe absolute pressure (PBA) signal from the ECU 5, and delivers a detected value of oxygen concentration and a value of internal resistance selected by a process, hereinafter described, to the ECU 5.

The LAF sensor 15 has a characteristic that a limiting current value thereof is proportional to the oxygen partial pressure of exhaust gases when a predetermined positive voltage V1 is applied to the sensor, and therefore is able to linearly detect the oxygen concentration in exhaust gases. However, the LAF sensor 15 requires heating up to a high temperature (approx. 800° C.) for activation thereof, and further, the activation temperature range thereof is narrow such that the activation of the LAF sensor 15 cannot be properly controlled by controlling the temperature of exhaust gases from the engine 1 alone. Therefore, it is necessary to carry out a process for maintaining the LAF sensor 15 in an activated state by detecting the internal resistance of the sensor (hereinafter referred to as "LAF sensor-activating process"). The oxygen concentration-detecting device 16 alternately carries out the LAF sensor-activating process and an oxygen concentration-detecting process at a certain changeover period T. The changeover period T is set with the heat capacity of the sensor element of the LAF sensor 15 and the heater 54, the cooling characteristic and activation temperature range of the LAF sensor 15, etc. taken in consideration.

In the oxygen concentration-detecting device 16 constructed as above, the predetermined positive voltage T1 is applied to the LAF sensor 15 by connecting the selector switch 66 to the positive bias source 64. Then, a value of current I1 generated from the LAF sensor 15 is detected by the current-detecting block 67, and the detected current value I1 is amplified and shaped by the amplifier 72 and converted to a digital value by the A/D converter 68, based upon which the oxygen concentration in exhaust gases (air-fuel ratio) is detected.

On the other hand, a predetermined negative voltage V2 is applied to the LAF sensor 15 by connecting the selector switch 66 to the negative bias source 65. Then, a value of current I2 from the LAF sensor 15 is detected by the current detecting block 67, and the detected current value I2 is amplified and shaped by the amplifier 72 and converted to a digital value by the A/D converter 68, based upon which the internal resistance LAFRI of the LAF sensor 15 is detected.

When the detected internal resistance LAFRI exceeds a predetermined reference value, the heater 54 is controlled by the heating controller 71 to operate, while if the detected internal resistance LAFRI is below the predetermined reference value, heating by the heater 54 is stopped by the heating controller 71. In this manner, the heat from the heater 54 is controlled such that the detected internal resistance LAFRI is maintained constant, to thereby always maintain the temperature of the LAF sensor 15 within the activation temperature range.

FIG. 3 shows a program for calculating the air-fuel ratio correction coefficient KLAF. This program is stored in the memory means 3*c* of the ECU 5 and executed by the CPU 5*b* in synchronism with generation of TDC signal pulses.

At a step S1 in FIG. 3, it is determined whether the engine rotational speed NE is higher than a predetermined upper limit NLAFH (e.g. 6,500 rpm). If the answer is affirmative (YES), i.e. NE>NLAFH holds, an integral term KLAFI used for calculation of the air-fuel ratio correction coefficient KLAF applied during air-fuel ratio feedback control by a program in FIGS. 4A and 4B, hereinafter described, and the correction coefficient KLAF are both set to a first high speed valve timing learned value KREFH0 at a step S20, and a flag FLAFFB, which is set to 1 during air-fuel ratio feedback control, is set to 0, followed by termination of the present program. The learned value KREFH0 is a learned value of the air-fuel ratio correction coefficient which is calculated when the desired air-fuel ratio is equal to or in the vicinity of the stoichiometric air-fuel ratio and at the same time the high speed valve timing is selected.

If the answer to the question of the step S1 is negative (NO), i.e. if NE≦NLAFH holds, it is determined whether increase of the fuel amount (fuel increase) is being carried out after the start of the engine, at a step S2. If the answer is negative (NO), it is determined whether the engine coolant temperature TW is equal to or lower than a predetermined value TWLAF (e.g. −25° C.), at a step S3. If the step S2 or S3 provides an affirmative answer (YES), the values KLAFI and KLAF are both set to a first low valve timing learned value KREFL0, at a step S21, and then the program proceeds to a step S22. The learned value KREFL0 is a learned value of the air-fuel ratio correction coefficient calculated when the desired air-fuel ratio is equal to or in the vicinity of the stoichiometric air-fuel ratio and at the same time the low valve timing is selected.

If the answer to the question of the step S3 is negative (NO), i.e. TW>TWLAF holds, it is determined whether a flag FWOT, which is set to a value of 1 when the engine is in a predetermined high load operating condition, has the value of 1, at a step S4. If the answer is negative (NO), i.e. FWOT=0 holds and accordingly the engine is not in the predetermined high load operating condition, the program jumps to a step S9, whereas if the answer is affirmative (YES), i.e. FWOT=1 holds, it is determined whether the engine rotational speed NE is equal to or higher than a predetermined value NLAFWOT (e.g. 5,000 rpm). If the answer to the step S5 is negative (NO), i.e. NF<NLAFWOT holds, it is determined whether the desired air-fuel ratio coefficient KCMD is larger than a predetermined value KCMDWOT (e.g. a value corresponding to A/F=12.5), at a step S6. If the answer is negative (NO), i.e. KCMD≦KCMDWOT holds, it is determined whether the engine is in a high coolant temperature and enriching region where fuel increase should be effected, at a step S7.

If any of the steps S5–S7 provides an affirmative answer (YES), i.e. NE≧NLAFWOT or KCMD>KCMDWOT holds, or the engine is in the high coolant temperature and enriching region, the values KLAFI and KLAF are both set to a value of 1. 0 at a step S8, and then the program proceeds to the step S22. If all the steps S5–S7 provide negative answers (NO), it is determined whether the engine rotational speed NE is equal to or lower than a predetermined lower limit NLAFL (e.g. 400 rpm), at a step S9. If the answer is negative (NO), i.e. NE>NLAFL holds, fuel cut (cutting-off of supply of fuel to the engine) is being carried out, at a step S10.

If either the step S9 or the step S10 provides an affirmative answer (YES), i.e. NE≦NLAFL holds, or if fuel cut being carried out, it is determined whether a count value tmD of a KLAF holding timer which is set to a predetermined time period tmDHLD (e.g. 1 sec) during air-fuel feedback control at a step S11, is a value of 0, at a step S14. If the answer is negative (NO), i.e. if tmD>0 holds, that is, if the predetermined time period tmDHLD has not yet elapsed after the air-fuel ratio feedback control was interrupted, a value $KLAF_{(k)}$ of the air-fuel ratio correction coefficient in the present loop is set to a value $KLAF_{(k-1)}$ assumed in the last loop, at a step S15, and the flag FLAFFB is set to 0 at a step S16, followed by terminating the present program. The suffixes (k) and (k−1) represent that the value with the suffix is the present value or the last value, and they are attached to other parameters in the specification, but (k) is normally omitted.

If the answer to the question of the step S14 is affirmative (YES), i.e. tmD=0 holds, that is, if the predetermined time period tmDHLD has elapsed, the values KLAFI and KLAF are both set to an idling learned value KREFIDL which is calculated while the engine is idling, at steps S17 and S18, and the flag FLAFFB is set to 0 at a step S19, followed by terminating the program.

If the answers to the questions of the steps S9, S10 are both negative (NO), it is judged that the engine is in an operating region in which the air-fuel ratio feedback control can be effected (hereinafter referred to as "the feedback control region"), and then the KLAF holding timer tmD is set to the predetermined time period tmDHLD and started, at a step S11. Further, the KLAF value is calculated by the program of FIGS. 4A and 4B, and the flag FLAFFB is set to 1 at a step S13, followed by terminating the program.

Figure 4A:
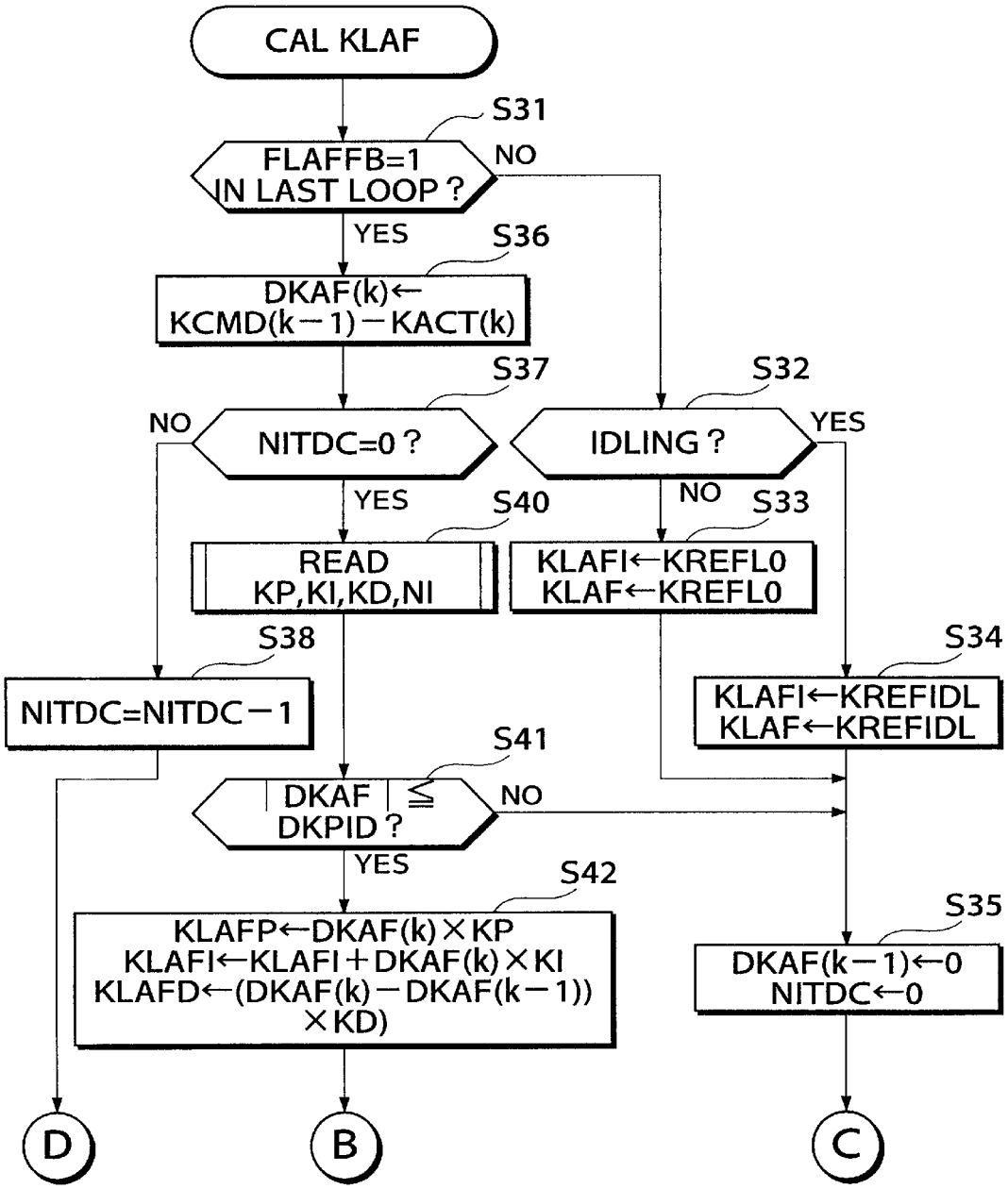
FIG. 4A is a flowchart of a subroutine for calculating the air-fuel ratio correction coefficient KLAF, which is executed at a step S12 of FIG. 3.
Figure 4B:
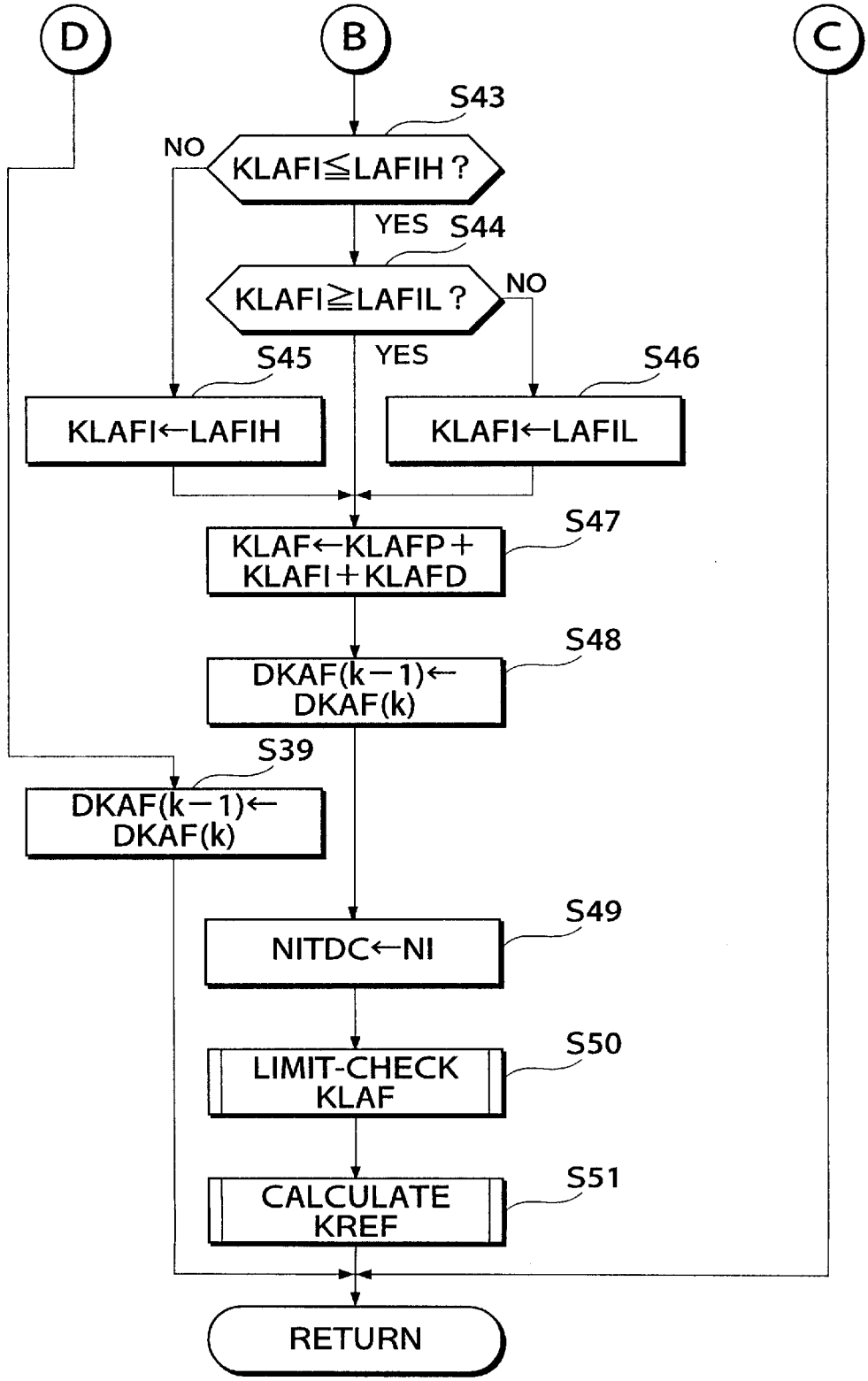
FIG. 4B is a continued part of the flowchart of FIG. 4A.

FIGS. 4A and 4B show details of the program for calculating the air-fuel ratio correction coefficient KLAF which is executed at the step S12 in FIG. 3.

At a step S31 in FIG. 4A, it is determined whether the flag FLAFFB assumed 1 at the time of generation of the immediately preceding TDC pulse (i.e. in the last loop of execution of the program of FIG. 3). If the answer is negative (NO), i.e. if the engine was not in the feedback control region and has first entered the same region in the present loop, the program proceeds to a step S32 where it is determined whether the engine is idling. If the answer to the step S32 is affirmative (YES), the values KLAFI and KLAF are both set to the idling learned value KREFIDL, at a step S34, and then the program proceeds to a step S35, whereas if the answer to the step S32 is negative (NO), the values KLAFI and KLAF are both set to the first low speed valve timing learned value KREFL0, at a step S33, followed by the program proceeding to the step S35.

At the step S35, an immediately preceding value $DKAF_{(k-1)}$ of the difference between the desired air-fuel ratio coefficient KCMD and the equivalent ratio (detected air-fuel ratio) KACT indicative of an air-fuel ratio detected by the LAF sensor 15 is set to a value of 0, and a thinning-out TDC variable NITDC is set to a value of 0, followed by terminating the present program. The thinning-out TDC variable NITDC is used to update the air-fuel ratio correction coefficient KLAF whenever TDC signal pulses equal in number to a thinning-out number NI are generated. If the answer to the question of a step S37, hereinafter referred to, is affirmative (YES), i.e. NITDC=0 holds, the program proceeds to a step S40, where updating of the KLAF value is carried out.

If the answer to the question of the step S31 is affirmative (YES), i.e. FLAFFB=1 holds, which. means that the engine was also in the feedback control region in the last loop, the difference $DKAF_{(k)}$ between the detected air-fuel ratio and the desired air-fuel ratio is calculated by subtracting a present value $KACT_{(k)}$ of the detected air-fuel ratio from an immediately preceding value $KCMD_{(k-1)}$ of the desired air-fuel ratio coefficient, at a step S36. Then, at a step S37, it is determined whether the thinning-out TDC variable NITDC has a value of 0. If the answer is negative (NO), i.e. NITDC>0, the value NITDC is decreased by a decrement of 1 at a step S38, and the present value $DKAF_{(k)}$ Of the above difference is set to the immediately preceding value $DKAF_{(k-1)}$ at a step S39, followed by terminating the program.

If the answer to the question of the step S37 is affirmative (YES), calculations are made of a proportional term (P term) coefficient KP, an integral term (I term) coefficient KI, a differential term (D term) coefficient KD, and the thinning-out number NI, at a step S40. The values KP, KI , KD and NI are set to respective predetermined values in each of a plurality of engine operating regions defined by the engine rotational speed NE, intake pipe absolute pressure PBA, etc. Therefore, values of KP, KI, KD and NI are read out which correspond to detected engine operating regions.

At a step S41, it is determined whether the absolute value of the difference DKAF calculated at the step S36 is smaller than a predetermined value DKPID. If the answer is negative (NO), i.e. |DKAF|>DXPID holds, the program proceeds to the step S35, whereas if the answer is affirmative (YES), i.e. |DKAF|≦DKPID holds, the program proceeds to a step S42. At the step S42, the P term KLAFP, I term KLAFI and D term KLAFD are calculated by the following equations (4)–(6):

$$KLAFP=DKAF(k)\times KP \quad (4)$$

$$KLAFI=KLAFI+DKAF_{(k)}\times KI \quad (5)$$

$$KLAFD=(DKAF_{(k)}-DKAF_{(k-1)})\times KD \quad (6)$$

At the following steps S43–S46, limit checking of the I term KLAFI calculated above is effected. Specifically, the calculated value KLAFI is compared with predetermined upper and lower limits LAFIH and LAFIL at the steps S43, S44. If the value KLAFI exceeds the upper limit LAFIH, the former is set to the latter (step S45), and if the value KLAFI falls below the lower limit LAFL, the former is set to the latter (step S46).

At the following step S47, the PID terms KLAFP, KLAFI, and KLAFD calculated as above are added together to calculate the air-fuel ratio correction coefficient KLAF. Then, the present value $DKAF_{(k)}$ of the difference calculated above is set to the immediately preceding value $DKAF_{(k-1)}$ at a step S48, and further the thinning-out TDC variable NITDC is set to the thinning-out number NI calculated at the step S40, at a step S49, followed by the program proceeding to steps S50 and S51.

At the step S50, limit checking of the KLAF value is effected by a program of FIG. 5, hereinafter described, and at the step S51, calculation of the learned value KREF of the air-fuel ratio correction coefficient KLAF is carried out, followed by terminating the present program.

Figure 5:
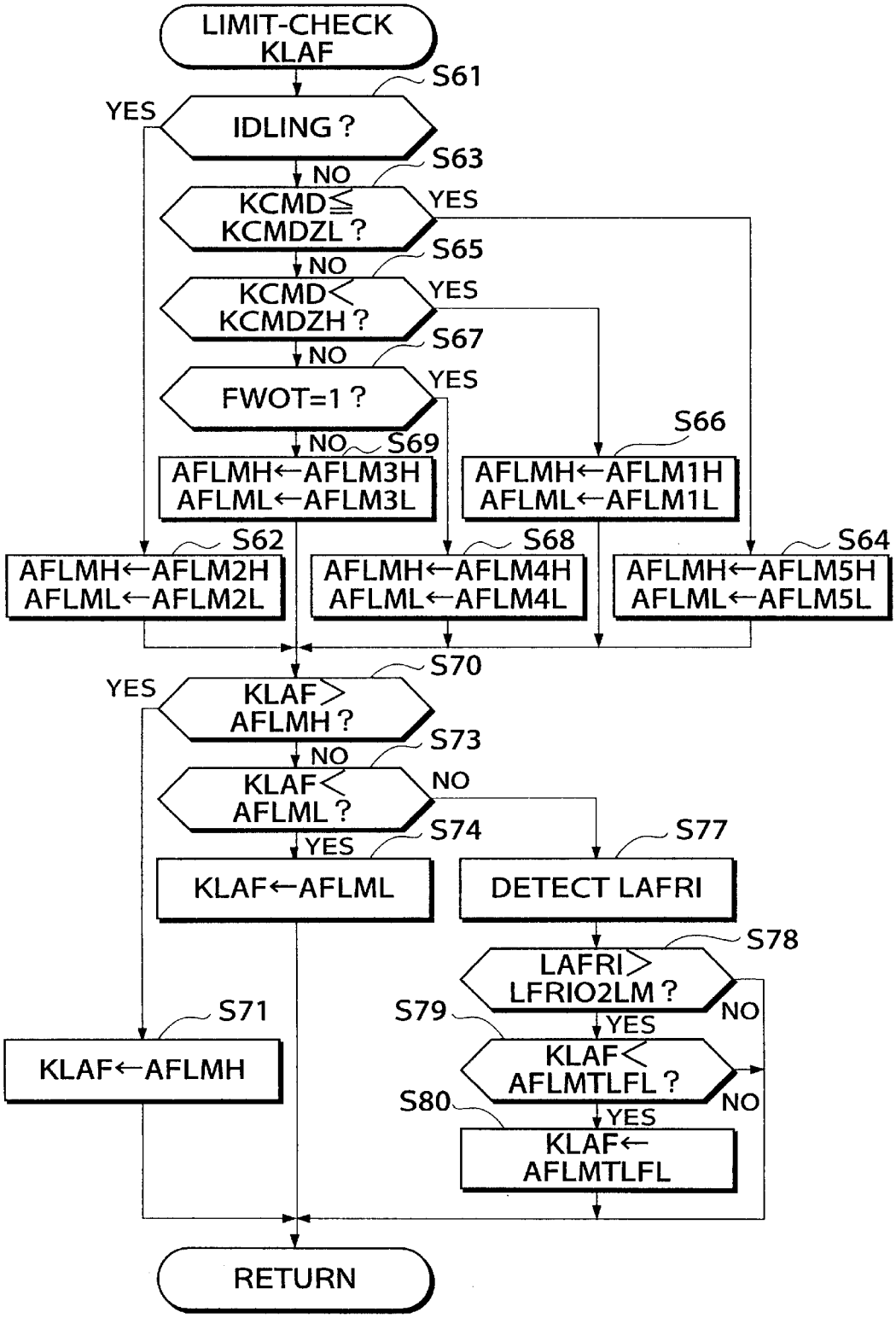
FIG. 5 is a flowchart of a subroutine for carrying out limit checking of the air-fuel ratio correction coefficient KLAF, which is executed at a step S50 of FIG. 4B.

FIG. 5 shows a subroutine for carrying out limit checking of the KLAF value, which is executed at the step S50 in FIG. 4B.

At a step S61, it is determined whether or not the engine is in an idling condition. If the answer is affirmative (YES), upper and lower value AFLMH and AFLML of the KLAF value are set to a predetermined upper value AFLM2H for idling (e.g. 1.4) and a predetermined lower limit value AFLM2L for idling (e.g. 0.3), respectively, at a step S62, and then the progrm proceeds to a step S70.

If the answer to the question of the step S61 is negative (NO), i.e. the engine is not in the idling condition, setting of the upper limit value AFLMH and the lower limit value AFLML is carried out depending upon the relationship between the desired air-fuel ratio coefficient KCMD and first and second predetermined values KCMDZL (e.g. a value equivalent to A/F of 20) and KCMDZH (e.g. a value equivalent to A/F of 13), at a steps S63–S66. More specifically, if the answer to the question of the step S63 is affirmative (YES), i.e. KCMD=KCMDZL holds, the upper and lower limit values AFLMH and AFLML are set to a predetermined upper limit value AFLM5H for lean-burn control (e.g. 1.6) and a predetermined lower limit value AFLM5L for lean-burn control (e.g. 0.4), respectively, at the step S64. If the answer to the question of the step S63 is negative (NO) and at the same time the answer to the question of the step S65 is affirmative (YES), i.e. KCMDZL<KCMD<KCMDZH holds, the upper and lower limit values AFLMH, AFLML are set to intermediate predetermined upper and lower limit values AFLM1H (e.g. 1.4) and AFLM1L (e.g. 0.6), respectively, at the step S66, and after execution of the steps S64 and S66, the program proceeds to the step S70.

If the answer to the question of the step S65 is negative (NO), i.e. KCMD≧KCMDZH holds, it is determined at a step S67 whether or not the flag FWOT is equal to 1. If the answer is negative (NO), i.e. if the engine is not in the high load condition, it is judged that the desired air-fuel ratio is set to a richer value because the engine coolant temperature is low, and then the upper and lower limit values AFLMH, AFLML are set to predetermined upper and lower values AFLM3H (e.g. 1.4) and AFLM3L (e.g. 0.6) for cold conditions, respectively, at a step S59, followed by the program proceeding to the step S70.

If the answer to the question of the step S67 is affirmative (YES), i.e. the engine is in the predetermined high load condition, the upper and lower limit values AFLMH, AFLML are set to predetermined upper and lower values AFLM4H (e.g. 1.5) and AFLM4L (e.g. 0.7) for high load conditions, respectively, at a step S68, followed by the program proceeding to the step S70.

As described above, according to the steps S61 to S69, the upper and lower limit values AFLMH, AFLML are changed according to the value of the desired air-fuel ratio coefficient KCMD. As a result, the control range of the fuel amount is set to a range appropriate to the desired air-fuel ratio, to thereby enable carrying out appropriate air-fuel ratio feedback control over a wide air-fuel ratio range.

Particularly, during lean-burn control (the answer to the question of the step S63 is affirmative (YES)), the value range that can be assumed by the coefficient KLAF can be made wider than during control of the air-fuel ratio to the stoichiometric air-fuel ratio (the answer to the question of the step S65 is affirmative (YES)) (AFLM5H>AFLM1H and AFLM5L<AFLM1L). Therefore, it is possible to follow up with improved response a change in the air-fuel ratio due to influence of evaporative fuel purged from a canister, not shown, etc.

Further, when the desired air-fuel ratio is set to a richer value than the stoichiometric air-fuel ratio (the answer to the question of the step S65 is negative (NO)), the value range that can be assumed by the coefficient KLAF can be made smaller than during lean-burn control, and it is therefore possible to prevent the air-fuel ratio of the mixture supplied to the engine from temporarily largely deviating from the desired air-fuel ratio, and hence avoid occurrence of a misfire and degraded accelerability of the engine.

At the step S70 and a step S73, the relationship between the upper and lower limit values AFLMH, AFLML set as above and the KLAF value is determined. If the KLAF value exceeds the upper limit value AFLMH (the answer to the question of the step S70 is affirmative (YES)), the KLAF value is set to the upper limit value AFLKMH (step S71), while if the KLAF value is smaller than the lower limit value AFLML (the answer to the question of the step S73 is affirmative (YES)), the KLAF value is set to the lower limit value AFLML (step S74), followed by terminating the program.

If it is determined at the steps S70 and S73 that the KLAF value falls between the upper and lower limit values AFLMH and AFLML (the steps S70 and S73 both provide affirmative answers), the program proceeds to a step S77, wherein the internal resistance LAFRI of the LAF sensor 15 is detected by the control device 25.

Then, to detect whether the LAF sensor 15 is in an activated state, it is determined at a step S78 whether or not the internal resistance LAFRI detected at the step S77 is larger than a predetermined value LFRIO2LM. If LAFRI>LFRIO2LM holds, it is determined at a step S79 whether or not the KLAF value is smaller than a predetermined value AFLMTLFL. The predetermined internal resistance value LFRIO2LM is the maximum value that the LAF sensor 15 can assume within the activation temperature range (approx. 700±50° C.). The predetermined KLAF value AFLMTLFL is set to a larger value (e.g. 0.9) than the lower limit value AFLML.

If as results of the determinations of the steps S78 and S79 LAFRI≦LFRIO2LM or KLAF≧AFLMTLFL holds, the program is terminated, while if LAFRI>LFRIO2LM and KLAF<AFLMTLFL hold, the KLAF value is set to the lower limit value AFLMTLFL at a step S80, followed by terminating the program.

As described above, according to the steps S70–S80, when the KLAF value falls between the upper and lower limit values AFLMH, AFLML (the steps S70 and S73 both provide negative answers), if the internal resistance LAFRI of the LAF sensor 15 exceeds the predetermined value LFRIO2LM at or below which the LAF sensor 15 can be assumed to be within the activation temperature range (approx. 700±50° C.), the lower limit value AFLML of the KLAF value is increased to the value AFLMTLFL which is larger than the lower limit value AFLML. As a result, even when the temperature of the LAF sensor 15 is so low that the output value of the sensor 15 deviates to the richer side and hence the oxygen concentration cannot be properly detected, it is possible to prevent excessive correction of the air-fuel ratio by the air-fuel ratio feedback control to thereby maintain the air-fuel ratio of the mixture within a proper range.

Although in the present embodiment, when the internal resistance LAFRI of the LAF sensor 15 exceeds the predetermined value LFRIO2LM, the lower limit value AFLML of the KLAF value is changed to the value AFLMTLFL, alternatively the upper limit value may then be set to a smaller value, or the value of at least one of the terms KP, KI, and KD of the equations (2A), (2B), and (2C) may be set to a smaller value to decrease the feedback gain of the air-fuel ratio control, whereby the response of the air-fuel ratio feedback control is reduced to obtain similar effects.

Next, a second embodiment of the invention will be described with reference to FIG. 6A to FIG. 11.

In the second embodiment, the air-fuel ratio correction coefficient KLAF calculated by the PID control and an adaptive correction coefficient KSTR which is calculated by adaptive control are selectively applied in the air-fuel ratio control. Except for this point, the second embodiment is identical with the above described first embodiment. In the following description, the correction coefficient KLAF will be referred to as "the PID correction coefficient" to discriminate the same from the adaptive correction coefficient KSTR.

In the present embodiment, the following equation (3) is used to calculate the fuel injection period TOUT, in place of the above given equation (1):

$$TOUT=Ti\times KCMDM\times KAF\times K1+K2 \quad (3)$$

where Ti, KCMDM and K1 and K2 represent the same parameters as used in the equation (1), and KAF represents an air-fuel ratio correction coefficient which is set to the PID correction coefficient KLAF or the adaptive correction coefficient KSTR in a process of FIGS. 6A and 6B, hereinafter described. The air-fuel ratio correction coefficient KAF is set to predetermined values corresponding to respective operating conditions of the engine during open loop control of the air-fuel ratio.

Figure 6A:
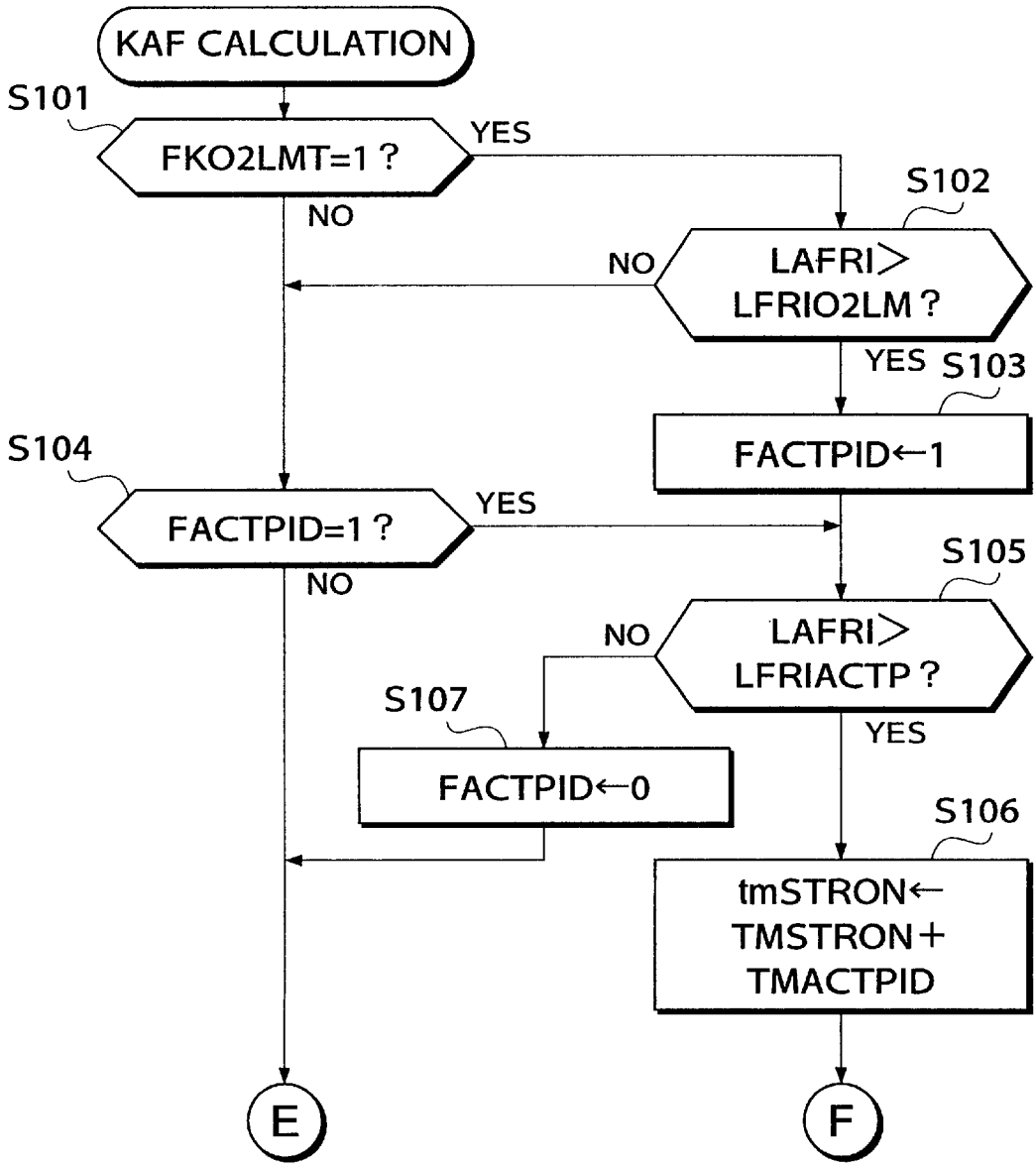
FIG. 6A is a flowchart of a main routine for calculating an air-fuel ratio correction coefficient KAF, according to a second embodiment of the invention.
Figure 6B:
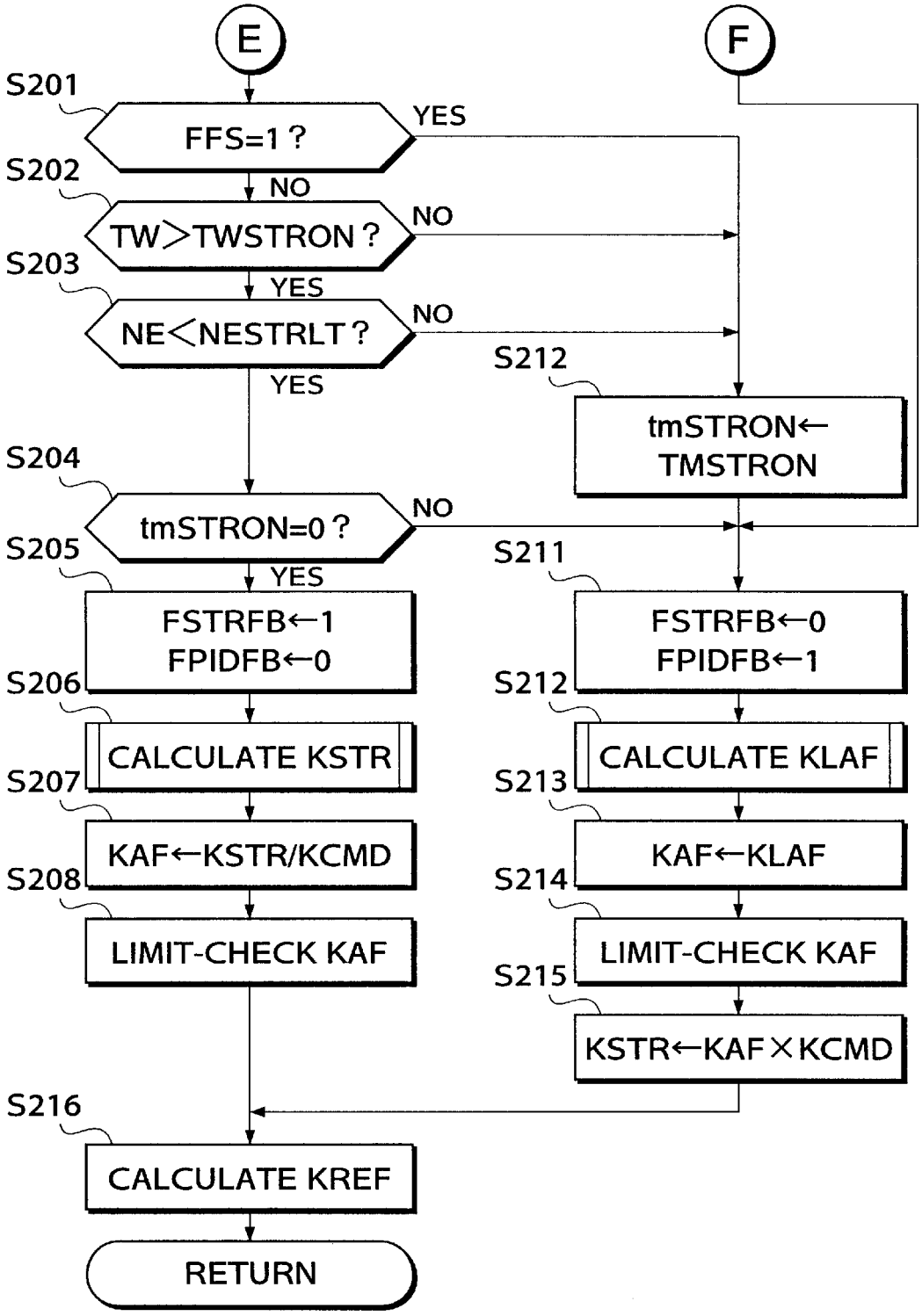
FIG. 6B is a continued part of the flowchart of FIG. 6A.

FIGS. 6A and 6B show a main routine for calculating the air-fuel ratio correction coefficient KAF, which is executed by the CPU 5*b* in synchronism with generation of TDC signal pulses.

At a step S101 in FIG. 6A, it is determined whether or not a limit-held state flag FKO2LMT is equal to 1. The flag FKO2LMT is set by a process of FIG. 8, hereinafter described and when set to 1, indicates that the air-fuel ratio correction coefficient KAF (PID correction coefficient KLAF or adaptive correction coefficient KSTR) has been set to a limit value (upper limit value or lower limit value) by a limit checking process. If FKO2LMT=1 holds, which means that the air-fuel ratio correction coefficient KAF has been set to the limit value (this state will be hereinafter referred to as "the limit-held state"), it is determined at a step S102 whether or not the internal resistance LAFRI of the LAF sensor 15 exceeds a first predetermined resistance value LFRIO2LM (the same as the predetermined value LFRIO2LM used in the first embodiment). If the answers to the questions of the steps S101 and S102 are both affirmative (YES), i.e. the air-fuel ratio correction coefficient KAF is in the limit-held state and at the same time the degree of activation of the LAF sensor 15 is low, a limit-held state and deactivation flag FACTPID is set to 1 to indicate such a state, at a step S103. Then, it is determined at a step S105 whether or not the internal resistance LAFRI exceeds a second predetermined resistance value LFRIACTP which is smaller than the first predetermined resistance value LFRIO2LM. If LAFRI>LFRIACTP holds, indicating that the degree of activation of the LAF sensor 15 is low (this occurs when the answer to the question of the step S102 is affirmative (YES)), a downcount timer tmSTRON, whose value is referred to at a step S204, hereinafter referred to, and which counts a delay time period before the air-fuel ratio control is changed from the PID control to the adaptive control, is set to the sum of a normal predetermined time period TMSTRON and a predetermined increment time period TMACTPID at a step S106, followed by the program proceeding to a step S211.

If it is determined at the step S105 that LAFRI≦LFRIACTP holds, indicating that the degree of activation of the LAF sensor 15 is high, the limit-held state and deactivation flag FACTPID is reset to 0 at a step S107, followed by the program proceeding to a step S201.

On the other hand, if the answer to the question of the step S101 or S102 is negative (NO), i.E. if FKO2LMT=0 holds, indicating that the air-fuel ratio correction coefficient KAF is not in the limit-held state, or that even if it is in the limit-held state, the degree of activation of the LAF sensor 15 is high. it is determined at a step S104 whether or not the limit-held and deactivation flag FACTPID has already been set to 1. If FACTPID=1 holds, the program proceeds to the step S105, whereas if FACTPID=0 holds, the program proceeds to the step S201.

At the step S201 in FIG. 6B, it is determined whether or not an abnormality detection flag FFS assumes 1. The abnormality detection flag FFS, when set to 1, indicates that a predetermined abnormality (e.g. an abnormality detected in the LAF sensor 15 or the throttle valve opening (θ TH) sensor 3', or a misfire) has been detected. If FFS=0 holds, it is determined at a step S202 whether or not the engine coolant temperature TW is higher than a predetermined value TWSTRON (e.g. 75° C.). If TW>TWSTRON holds, it is determined at a step S203 whether or not the engine rotational speed NE is higher than a predetermined value NESTRLT (e.g. 5000 rpm). If the answer to the question of the step S201 is affirmative (YES) or the answer to either the question of the step S202 or S203 is negative (NO), the timer tmSTRON is set to a predetermined time period TMSTRON and started at a step S212 to adopt the PID correction coefficient KLAF as the feedback correction coefficient KAF, and then the program proceeds to the step S211. On the other hand, if the answer to the question of the step S201 is negative (NO) and at the same time the answers to the questions of the steps S202 and S203 are both affirmative (YES), it is determined at the step S204 whether or not the value of the timer tmSTRON is equal to 0. So long as tmSTRON>0 holds, the program proceeds to the step S211, and when tmSTRON=0 holds, the program proceeds to a step S204 to adopt the adaptive correction coefficient KSTR as the feedback correction coefficient KAF.

Figure 10:
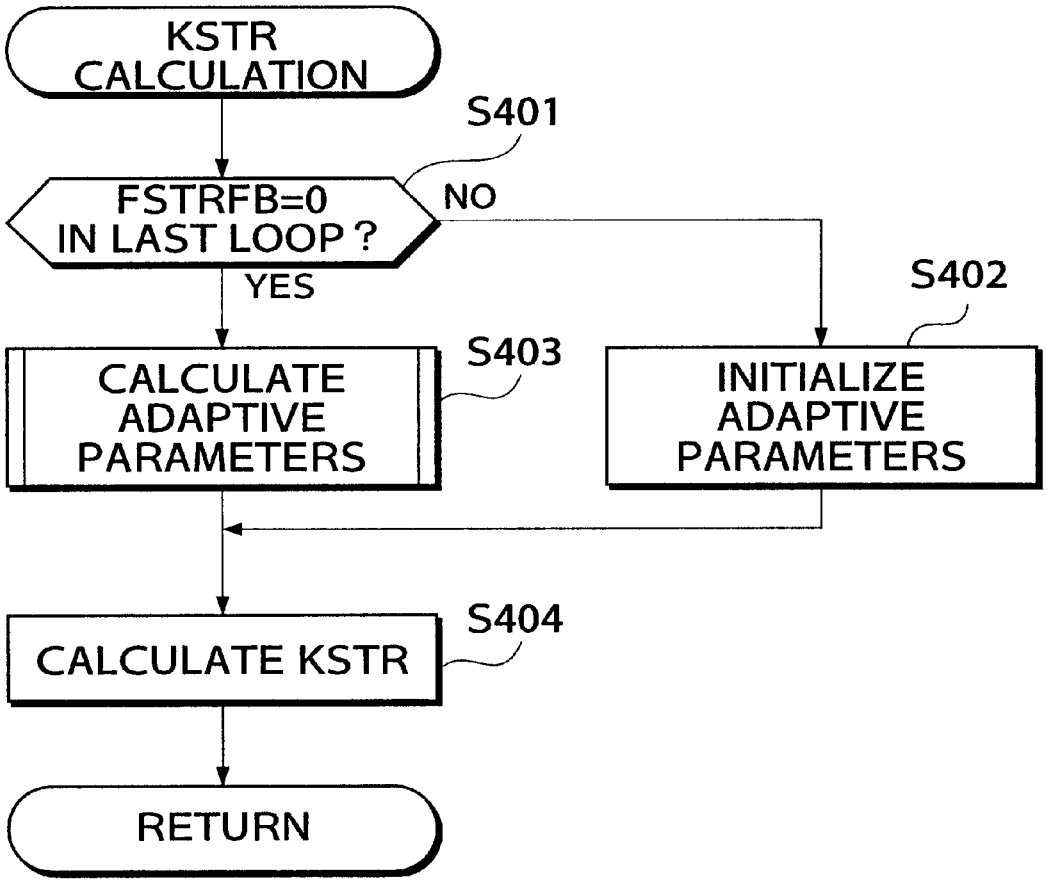
FIG. 10 is a flowchart of a subroutine for calculating the adaptive correction coefficient: KSTR, which is executed at a step S206 of FIG. 6B.

At the step S205, an adaptive control flag FSTRFB, which when set to 1, indicates that the adaptive correction coefficient KSTR is adopted as the air-fuel ratio correction coefficient KAF, is set to 1 and a PID control flag FPIDFB, which when set to 1, indicates that the PID correction coefficient is adopted as the air-fuel ratio correction coefficient KAF, is set to 0, and a KSTR-calculating process, shown in FIG. 10, is executed at a step S206. Then, the feedback correction coefficient KAF is set to a value obtained by dividing the adaptive correction coefficient KSTR by the desired equivalent ratio KCMD at a step S207, and limit checking of the feedback correction coefficient KAF, details of which will be described hereinafter with reference to FIGS. 8A and 8B, is executed at a step S208. The process of the step S207 is for preventing double multiplication of the basic fuel amount Ti by a factor corresponding to the desired equivalent ratio KCMD since the adaptive correction coefficient KSTR is calculated such that the detected equivalent ratio KACT becomes equal to the desired equivalent ratio KCMD, and hence contains the above factor.

Then, at a step S216, a learned value KREFi (i=0, 1) is calculated by the use of the following equation (2). The suffix i of the learned value KREFi represents an operating condition parameter, which is set to 0 when the engine is idling, and set to 1 when the engine is in a condition other than idling. The learned value KREFi is calculated for each of the operating conditions of the engine:

$$KREFi=CREF\times KAF+(1-CREF)\times KREFi \quad (2)$$

where KREFi on the right side represents an immediately preceding value of the learned value KREFi, and CREF an averaging coefficient which is set to a value between 0 and 1.

Figure 7A:
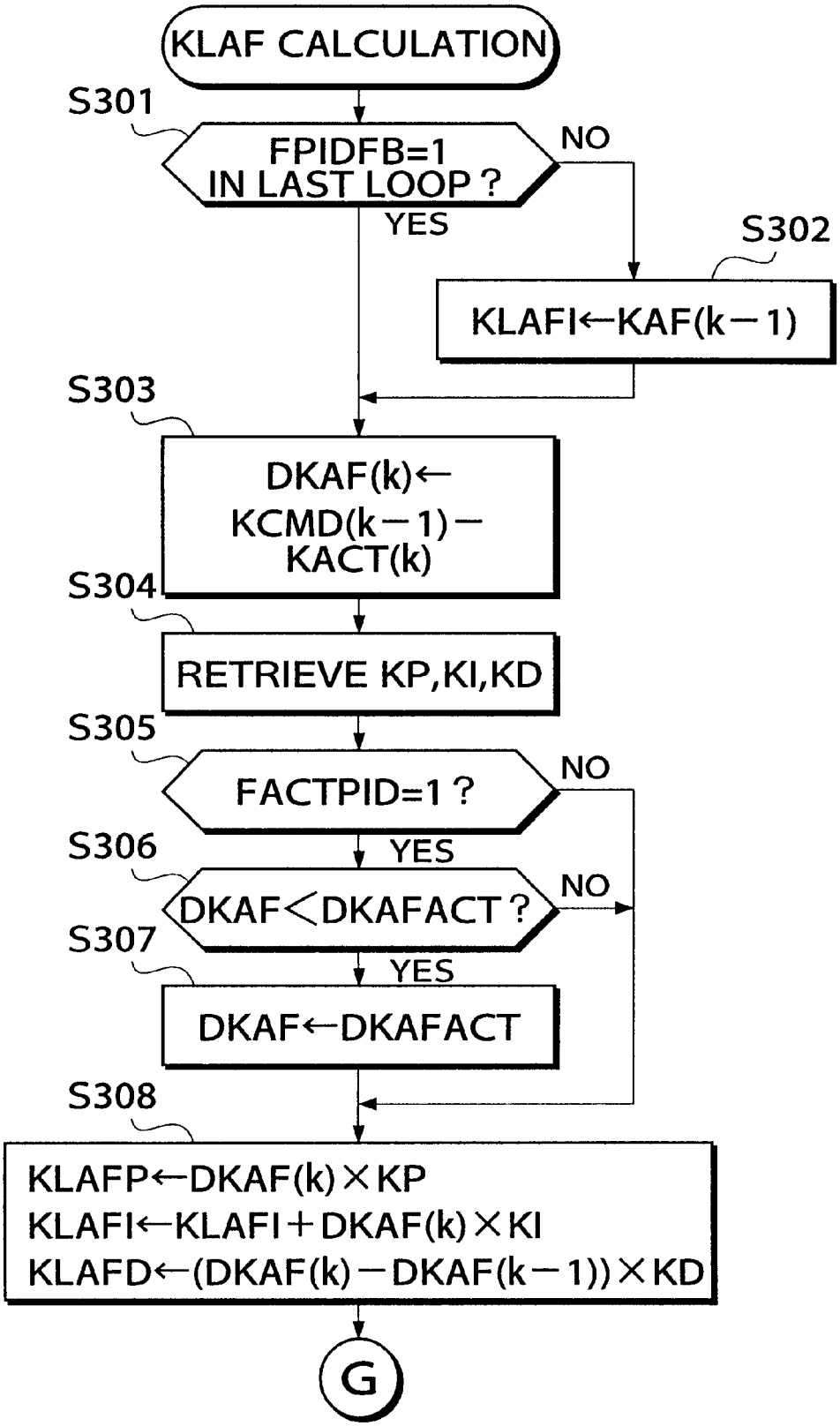
FIG. 7A is a flowchart of a subroutine for calculating the air-fuel ratio correction coefficient KLAF for use in PID control, which is executed at a step S212 of FIG. 6B.
Figure 7B:
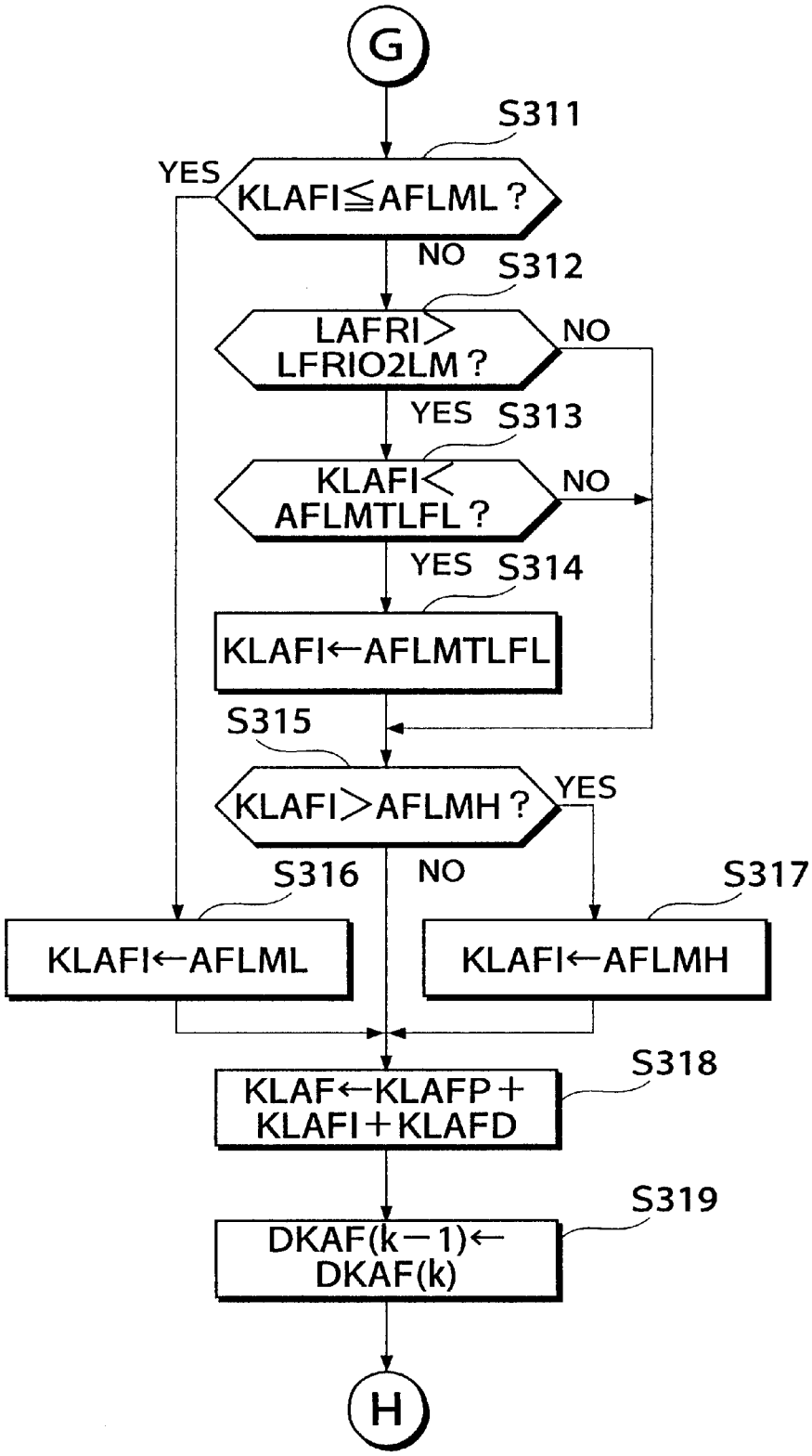
FIG. 7B is a continued part of the flowchart of FIG. 7A.

On the other hand, at the step S211 the adaptive control flag FSTRFB is set to 0 and the PID control flag FPIDFB is set to 1, and then a KLAF-calculating process, shown in FIGS. 7A and 7B, is executed at a step S212. At the following step S213, the feedback correction coefficient KAF is set to the PID correction coefficient KLAF calculated at the step S212, and limit checking of the feedback correction coefficient KAF, details of which will be described with reference to FIG. 8, is carried out at a step S214. Then, at a step S215, the adaptive correction coefficient KSTF is set to a value obtained by multiplying the PID correction coefficient KLAF by the desired equivalent ratio KCMD, so that the value KLAF×KCMD is used as an initial value of the adaptive correction coefficient KSTR when the adaptive control is started. After execution of the step S215, the program proceeds to the step S216, wherein the learned value KREFi is calculated.

According to the process of FIGS. 6A and 6B described above, when the limit-held state flag FKO2LMT is equal to 1, indicating that the air-fuel ratio correction coefficient KAF is in the limit-held state (step S101), and at the same time the degree of activation of the LAF sensor 15 is low (LAFRI>LFRIO2LM) (step S102), or FACTPID=1 and LAFRI>LFRIACTP hold (steps S103–S105), execution of the adaptive control using the adaptive correction coefficient KSTR is inhibited, and the PID control using the PID correction coefficient KLAF is executed. As a result, even when the degree of activation of the LAF sensor is so low that the output from the oxygen concentration sensor deviates from a proper value leading to inaccurate detection of the oxygen concentration (air-fuel ratio), it is possible to prevent excessive correction of the air-fuel ratio by the air-fuel ratio feedback control to thereby maintain the air-fuel ratio of the mixture within a proper range. That is, since the adaptive control can be more largely influenced by a deviation in the output from the LAF sensor than the PID control, the execution of the adaptive control is inhibited under the above-mentioned conditions, to thereby enable prevention of excessive correction of the air-fuel ratio.

Figure 7C:
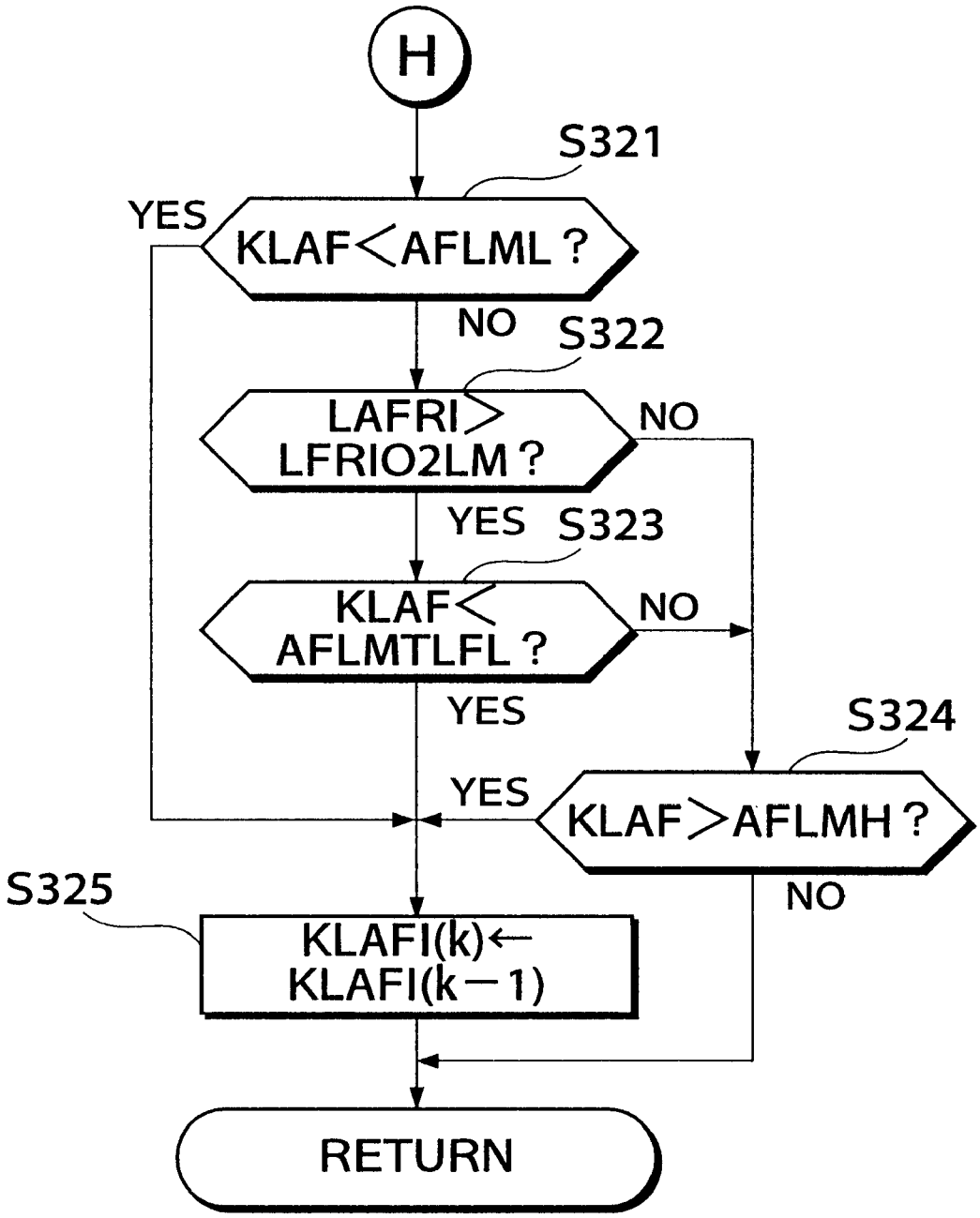
FIG. 7C is a further continued part of the flowchart of FIG. 7A

FIGS. 7A to 7C show the KLAF-calculating process which is executed at the step S212 in FIG. 6*b*.

At a step S301 in FIG. 7A, it is determined whether or not the PID control flag FPIDFB assumed 1 in the last loop. If FPIDFB=1 held in the last loop, the program jumps to a step S303, while if FPIDFB=0 held in the last loop, the I term KLAFI of the PID control is set to an immediately preceding value $KAF_{(k-1)}$ of the air-fuel ratio correction coefficient KAF at a step S302, followed by the program proceeding to the step S303. At the step S303, a difference DKAF between the detected equivalent ratio KACT and the desired equivalent ratio KCMD ($=KCMD_{(k-1)}-KACT_{(k)}$) is calculated. Then, retrieval of the proportional term (P term) coefficient KP, integral term (I term) coefficient KI, and differential term (D term) coefficient KD is carried out at a step S304. The coefficients KP, KI and KD are set to respective predetermined values for each of engine operating regions determined according to the engine rotational speed NE, the intake pipe absolute pressure PBA, etc., and values of the coefficients KP, KI and KD are read out from maps, not shown, which correspond to the detected operating condition of the engine.

At the following step S305, it is determined whether or not the limit-held state and deactivation flag FACTPID is equal to 1. If FACTPID=1 holds, it is determined at a step S306 whether or not the above difference DKAF is smaller than a negative predetermined lower limit DKAFACT (e.g. −0.015). If DKAF<DKAFACT holds, the difference DKAF is set to the negative predetermined lower limit DKAFACT at a step S307, followed by the program proceeding to a step S308. That is, If FACTPID=1 holds, indicating that the air-fuel ratio correction coefficient KAF is in the limit-held state and at the same time the degree of activation of the LAF sensor 15 is low, the controlled air-fuel ratio deviation DKAF is limited such that it becomes equal to or larger than the negative predetermined lower limit DKAFACT. By this limiting, an amount of rich-side deviation of the detected equivalent ratio KACT from the desired equivalent ratio KCMD is limited to or below |DKAFACT|, whereby excessive correction of the air-fuel ratio by the air-fuel ratio feedback control using the PID correction coefficient KLAF can be prevented, to maintain the air-fuel ratio within a proper range. The detected equivalent ratio KACT tends to increase as the air-fuel ratio becomes smaller (richer).

At the step S308, calculations of the P term KLAFP, I term KAFI and D term KLAFD are executed, using the aforegiven equations (2A), (2B) and (2C), similarly to the step S42 in FIG. 4A. At the following steps S311 to S317, limit checking of the I term KLAFI is carried out. First, at the step S311, it is determined whether or not the I term KLAFI is equal to or smaller than the predetermined lower limit value AFLML. If KLAFI<AFLML holds, the I term KLAFI is set to the predetermined lower limit value AFLML at the step S316, followed by the program proceeding to a step S318. If KLAFI>AFLML holds, it is determined whether or not the internal resistance LAFRI of the LAF sensor 15 is larger than the first predetermined resistance value LFRIO2LM at a step S312. If LAFRI>LFRIO2LM holds, it is determined whether or not the I term KLAFI is smaller than the predetermined value AFLMTLFL at a step S313. The predetermined value AFLMTLFL is set to a value (e.g. 0.9) larger than the lower limit value AFLML, similarly to the step S79 in FIG. 5.

If as results of the determinations at the steps S312 and S313 LAFRI≦LFRIO2LM or KLAFI≧AFLMTLFL holds, the program jumps to a step S315, while if LAFRI>LFRIO2LM and KLAFI<AFLMTLFL hold, the KLAFI value is set to the lower limit value AFLMTLFL at a step S314, followed by the program proceeding to the step S315.

At the step S315, it is determined whether or not the I term KLAFI is larger than the predetermined upper limit value AFLMH. If KLAFI≦AFLMH holds, the program jumps to the step S318, while if KALFI>AFLMH holds, the I term KLAFI is set to the upper limit AFLMH at a step S317, followed by the program proceeding to the step S318.

At the step S318, the P term KLAFP, I term KLAFI and D term KLAFD are added together to obtain a value of the PID correction coefficient KLAF, and then a present value $DKAF_{(k)}$ of the difference DKAF is set to an immediately preceding value $DKAF_{(k-1)}$ at a step S319, followed by the program proceeding to a step S321.

At the step S321, it is determined whether or not the PID correction coefficient KLAF is smaller than the predetermined lower limit value AFLML. If KLAF<AFLML holds, the I term KLAFI is set to an immediately preceding value $KLAFI_{(k-1)}$ thereof at a step S325, followed by terminating the program. If KLAF≧AFLML holds, it is determined at a step S322 whether or not the internal resistance LAFRI of the LAF sensor 15 is larger than the first predetermined resistance value FLRIO2LM. If LAFRI>LFRIO2LM holds, it is determined at a step S323 whether or not the PID correction coefficient KLAF is smaller than the predetermined value AFLMTLFL.

If as results of the determinations at the steps S322 and S323, LAFRI≦LFRIO2LM or KLAF≧AFLMTLFL holds, the program proceeds to a step S324, while if LAFRI>LFRIO2LM and KLAF<AFLMTLFL hold, the program proceeds to the step S325.

At the step S324, it is determined whether or not the PID correction coefficient KLAF is larger than the predetermined upper limit value AFLMH. If KLAF≦AFLMH holds, the program is immediately terminated, while if KLAFI>AFLMH holds, the program jumps to the step S325, followed by terminating the program.

FIG. 8 shows the KAF limit checking process which is executed at the steps S208 and S214. The present process has almost the same structure as the KLAF limit-checking process of FIG. 5. More specifically, "KLAF" of the steps S70, S71, S73, S74, S79 and S80 in FIG. 5 is changed to "KAF" and the step numbers of these steps are changed to S70*a*, S71*a*, S73, S74*a*, S79*a* and S80*a*, respectively, with further steps S81 and S82 added. Thus, limit checking of the calculated air-fuel ratio correction coefficient KAF (i.e. PID correction coefficient KLAF or adaptive correction coefficient KSTR) is carried out similarly to that of FIG. 5, and further, when the air-fuel ratio correction coefficient KAF is in the limit-held state (when the step S71*a*, S74*a* or S80*a* has been executed), the limit-held state flag FKO2LMT is set to 1 at the step S81, and otherwise, the flag FKO2LMT is set to 0 at the step S82, followed by terminating the program.

According to the present process, as described above, when the KLAF value falls within the range between the upper and lower limit values AFLMH and AFLML (the steps S70*a* and S73*a* both provide negative answers), the temperature of the LAF sensor 15 is in the activation temperature range (approx. 700±50° C.), and at the same time the internal resistance of the LAF sensor 15 exceeds the predetermined resistance value LFRIO2LM, the lower limit value AFLML of the KAF value is increased to the predetermined value AFLMTLFL larger than the lower limit value AFLML. As a result, even when the temperature of the LAF sensor 15 is so low that the output value of the sensor 15 deviates to the richer side and hence the oxygen concentration (air-fuel ratio) cannot be properly detected, it is possible to prevent excessive correction of the air-fuel ratio by the air-fuel ratio feedback control, to thereby maintain the air-fuel ratio of the mixture within a proper range.

Next, description will be made of a calculation of the adaptive correction coefficient KSTR (KSTR-calculating process), which is executed at the step S206 in FIG. 6B, with reference to FIGS. 9 to 11.

Figure 9:
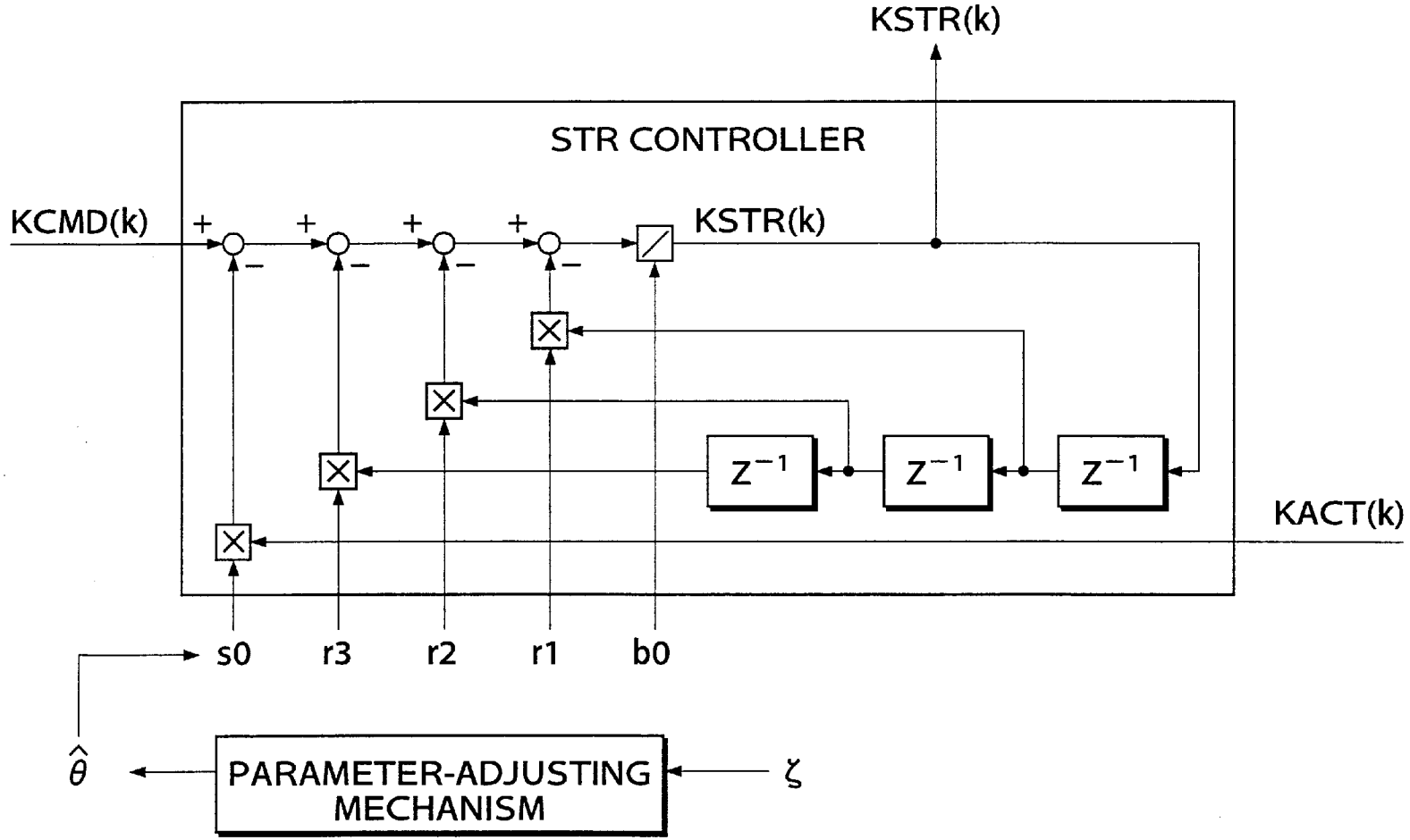
FIG. 9 is a block diagram useful in explaining a manner of calculating an adaptive correction coefficient KSTR.

FIG. 9 shows the construction of a self-tuning regulator (hereinafter referred to as the STR). The STR is comprised of a STR controller for setting the adaptive correction coefficient KSTR such that the actual equivalent ratio $KACT_{(k)}$ becomes equal to the desired air-fuel ratio coefficient (desired equivalent ratio) $KCMD_{(k)}$, and an adaptive parameter-adjusting mechanism for setting adaptive parameters to be used by the STR controller.

Known adjustment laws (mechanisms) for adaptive control include a parameter adjustment law proposed by Landau et al. This method is described, e.g. in Computrole No. 27, CORONA PUBLISHING CO., LTD., Japan, pp. 28–41, Automatic control handbook OHM, LTD., Japan, pp. 703–707, A Survey of Model Reference Adaptive Techniques—Theory and Application, I. D. LANDAU Automatic Vol. 10, pp. 353–379, 1974, Unification of Discrete Time Explicit Model Reference Adaptive Control Designs, I. D. LANDAU et al. Automatic Vol. 17, No. 4, pp. 593–611, 1981, and Combining Model Reference Adaptive Controllers and Stochastic Self-tuning Regulators, I. D. LANDAU Automatic Vol. 18, No. 1., pp. 77–84, 1982. In the present embodiment, the above parameter adjustment law proposed by Landau et al. is employed. This parameter adjustment law will be described in detail, hereinbelow: According to this adjustment law, if polynomials of the denominator and numerator of the transfer function $A(Z^{-1})/B(Z^{-1})$ of the controlled object by a discrete system are expressed by the following equations (4A) and (4B), the adaptive parameter vector $\hat{\theta}^T(k)$ and the input $\zeta^T(k)$ to the adaptive parameter adjusting mechanism are defined by the following equations (5) and (6). The equations (5) and (6) define an example of a plant in which m=1, n=1 and d=3 hold, i.e. a system of the first order thereof has a dead time, referred to hereinafter, as long as three control cycles. The symbol k used herein indicates that the parameter with (k) has the present value, one with (k−1) the immediately preceding value, and so forth, which correspond to respective control cycles. u(k) and y(k) in the equation (6) correspond to the KSTR(k) and KACT(k) values, respectively, in the present embodiment.

$$A(z^{-1}) = 1 + a_1 z^{-1} + \ldots + a_n z^{-n} \tag{4A}$$

$$B(z^{-1}) = b_0 + b_1 z^{-1} + \ldots + b_m z^{-m} \tag{4B}$$

$$\begin{aligned}\hat{\theta}^T(k) &= [b_0(k), r_1(k), \ldots r_{m+d-1}(k), s_0(k), \ldots, s_{n-1}(k)] \\ &= [b_0(k), r_1(k), r_2(k), r_3(k), s_0(k)]\end{aligned} \tag{5}$$

-continued $$\zeta^T(k) = [u(k), \ldots, u(k-m-d+1), y(k), \ldots, y(k-n+1)] = [u(k), u(k-1), u(k-2), u(k-3), y(k)] \quad (6)$$

The adaptive parameter $\hat{\theta}(k)$ is expressed by the following equation (7):

$$\hat{\theta}(k)=\hat{\theta}(k-1)+\Gamma(k-1)\zeta(k-d)e^*(k) \quad (7)$$

where the symbols $\Gamma$ (k) and e* (k) represent a gain matrix and an identification error signal, respectively, and can be expressed by the following recurrence formulas (8) and (9):

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \quad (8)$$

$$e^*(k) = \frac{D(z^{-1})y(k) - \hat{\theta}^T(k-1)\zeta(k-d)}{1+\zeta^T(k-d)\Gamma(k-1)\zeta(k-d)} \quad (9)$$

Further, it is possible to provide various specific algorithms depending upon set values of $\lambda_1$ (k) and $\lambda_2$ (k) in the equation 8). For example, if $\lambda_1$ (k)=1 and $\lambda_2$ (k)=$\lambda$ (0<$\lambda$<2) hold, a progressively decreasing gain algorithm is provided (if $\lambda$=1, the least square method), if $\lambda_1$ (k)=$\lambda_1$ (0<$\lambda_1$<) and $\lambda_2$ (k)=$\lambda_2$ (0<$_2$<2) hold, a variable gain algorithm (if $\lambda_2$<1, the method of weighted least squares), and if $\lambda_1$ (k)/$\lambda_2$ (k)=$\alpha$ and if $\lambda_3$ is expressed by the following equation (10), $\lambda_1$ (k)=$\lambda_3$ provides a fixed trace algorithm. Further, if $\lambda_1$ (k)=1 and $\lambda_2$ (k)=0 hold, a fixed gain algorithm is obtained. In this case, as is clear from the equation (7), $\Gamma$ (k)=$\Gamma$ (k−1) holds, and hence $\Gamma$ (k)=$\Gamma$ (fixed value) is obtained.

further, $D(Z^{-1})$ in the equation (9) is an asymptotically stable polynomial which can be defined by a system designer as desired to determine the convergence of the system. In the present embodiment, $D(Z^{-1})$ is set to 1.0.

$$\lambda_3(k) = 1 - \frac{\|\Gamma(k-1)\zeta(k-d)\|^2}{\alpha+\zeta^T(k-d)\Gamma(k-1)\zeta(k-d)} \cdot \frac{1}{\mathrm{tr}\Gamma(0)} \quad (10)$$

In the equation (10), tr$\Gamma$ (0) is a trace function of the matrix $\Gamma$ (0), and specifically , it is a sum (scalar) of diagonal components of the matrix $\Gamma$ (0).

In the example of FIG. 9, the STR controller and the adaptive parameter-adjusting mechanism are arranged outside the fuel injection amount-calculating system, and operate to calculate the adaptive correction coefficient KSTR(k) such that the actual equivalent ratio KACT(k+d) becomes equal to a desired equivalent ratio KCMD(k) in an adaptive manner, where d' represents a dead time which is a delay time elapsed before the desired equivalent ratio KCMD is actually reflected on the actual equivalent ratio KACT.

In this manner, the adaptive correction coefficient KSTR (k) and the actual equivalent ratio KACT(k) are determined, which are input to the adaptive parameter-adjusting mechanism, where the adaptive parameter $\hat{\theta}$(k) is calculated to be input to the STR controller. The STR controller is also supplied with the desired equivalent ratio KCMD(k) and calculates the adaptive correction coefficient KSTR(k) such that the actual equivalent ratio KACT(k+d) becomes equal to the desired equivalent ratio KCMD(k), by using the following recurrence formula (11):

$$KSTR(k) = \frac{KCMD(k-d') - s_0 \times KACT(k) - r_1 \times KSTR(k-1) - r_2 \times KSTR(k-2) - r_3 \times KSTR(k-3)}{b_0} \quad (11)$$

Next, the equation for calculating the adaptive correction coefficient KSTR actually employed in the present embodiment will be described. The above equations (6) to (11) are applied to a case where the control cycle and the repetition period of calculation of the KSTR value (repetition period of generation of TDC signal pulses) coincide with each other and the adaptive correction coefficient KSTR thus calculated is commonly used for all the cylinders. In the present embodiment, however, the control cycle is as long as four TDC signal pulses corresponding to the number of cylinders, whereby the adaptive correction coefficient KSTR is determined cylinder by cylinder. More specifically, the above-mentioned equations (6) to (11) are replaced by the following equations (12) to (17), respectively, to calculate the adaptive correction coefficient KSTR cylinder by cylinder for use in the adaptive control:

$$\zeta^T(k) = [u(k), u(k-4), u(k-8), u(k-12), y(k)] \quad (12)$$

$$\hat{\theta}(k) = \hat{\theta}(k-4) + \Gamma(k-4)\zeta(k-4\times d)\,e^*(k) \quad (13)$$

$$\Gamma(k) = \frac{1}{\lambda_1(k)}\left[\Gamma(k-4) - \frac{\lambda_2(k)\Gamma(k-4)\zeta(k-4\times d)\zeta^T(k-4\times d)\Gamma(k-4)}{\lambda_1(k)+\lambda_2(k)\zeta^T(k-4\times d)\Gamma(k-4)\zeta(k-4\times d)}\right] \quad (14)$$

$$e^*(k) = \frac{D(Z^{-1})y(k) - \hat{\theta}^T(k-4)\zeta(k-4\times d)}{1+\zeta^T(k-4\times d)\Gamma(k-4)\zeta(k-4\times d)} \quad (15)$$

$$\lambda_3(k) = 1 - \frac{\|\Gamma(k-4)\zeta(k-4\times d)\|^2}{\alpha+\zeta^T(k-4\times d)\Gamma(k-4)\zeta(k-4\times d)} \cdot \frac{1}{\mathrm{tr}\Gamma(0)} \quad (16)$$

$$KSTR(k) = \{KCMD(k) - s_0 \times KACT(k) - r_1 \times KSTR(k-4) - r_2 \times KSTR(k-8) - r_3 \times KSTR(k-12)\} / b_0 \quad (17)$$

When the actual dead time dact is "4" for example, d in the above formulas (14) to (16) is set to "4" to calculate the adaptive parameters $b_0$, $s_0$, and $r_1$ to $r_3$.

FIG. 10 shows a subroutine for calculating the adaptive correction coefficient KSTR, which is executed at the step S206 in FIG. 6B.

First, at a step S401, it is determines whether or not the adaptive control flag FTRSFB assumed 1 in the last loop. If FSTRFB=0 holds, which means that the adaptive control was not executed in the last loop, the adaptive parameters $b_0$, $s_0$, and $r_1$ to $r_3$ are set to initial values at a step S402, followed by the program proceeding to a step S404. If FSTRFB=1 holds at the step S401, indicating that the adaptive control was also executed in the last loop, calculations of the adaptive parameters $b_0$, $s_0$, and r1 to r3 are executed by a subroutine shown in FIG. 11, hereinafter described.

In the present embodiment, the calculation of the value $\hat{\theta}$(k), i.e. the adaptive parameters $b_0$, $s_0$, and $r_1$ to $r_3$ by using the equation (13) is carried out once per four TDC periods (a period four times as long as the time interval between adjacent TDC signal pulses=one combustion cycle). Therefore, it is determined at a step S431 in FIG. 11 whether or not four TDC periods have elapsed from the last calculation of the adaptive parameters using the formula (13). If it is determined that four TDC periods have elapsed, calculations are made of the adaptive parameters $b_0$, $s_0$, and $r_1$ to $r_3$ at a step S432. On the other hand, if four TDC periods have not elapsed, the adaptive parameters $b_0(k)$, $s_0(k)$, and $r_1(k)$ to $r_3(k)$ are set to the last values $b_0(k-1)$, $s_0(k-1)$, and $r_1(k-1)$ to $r_3(k-1)$, respectively, at a step S433.

After execution of the step S432 or S433, moving average values $b_0AV$, $s_0AV$, $r_1AV$, $r_2AV$ and $r_3AV$ of the respective adaptive parameters $b_0$, $s_0$, and $r_1$ to $r_3$ over the four-TDC pulse period are calculated by the use of the following equations (18), at a step S434, followed by terminating the program:

$$b0AV = \sum_{i=0}^{p-1} b_0(k-i)/p \qquad s0AV = \sum_{i=0}^{p-1} s_0(k-i)/p \tag{18}$$

$$r1AV = \sum_{i=0}^{p-1} r_1(k-i)/p \qquad r2AV = \sum_{i=0}^{p-1} r_2(k-i)/p$$

$$r3AV = \sum_{i=0}^{p-1} r_3(k-i)/p$$

Figure 11:
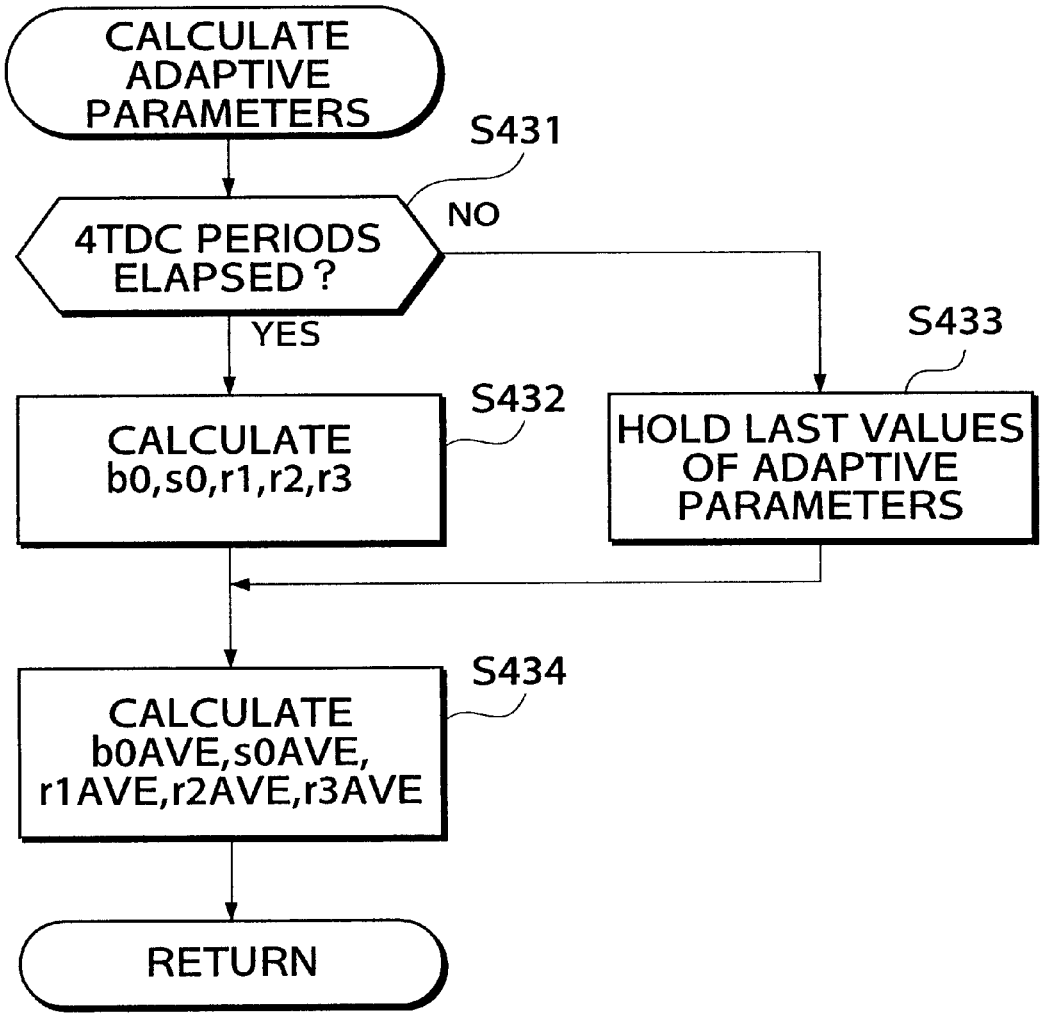
FIG. 11 is a flowchart of a subroutine for calculating adaptive parameters, which is executed at a step S403 of FIG. 10.

Referring back to FIG. 10, at the step S404, the moving average values $b_0AV$, $s_0AV$, $r_1AV$, $r_2AV$ and $r_3AV$ of the adaptive parameters obtained at the step S434 in FIG. 11 are substituted into the equation (17), to calculate the adaptive correction coefficient KSTR. By thus using the moving average values of the adaptive parameters $b_0$, $s_0$, and $r_1$ to $r_3$, it is possible to prevent the adaptive control from becoming unstable due to the updating of the adaptive parameters $b_0$, $s_0$, and $r_1$ to $r_3$ once per four TDC periods and a low-pass characteristic of the LAF sensor 15.

What is claimed is:

1. In an air fuel ratio control system for an internal combustion engine having an exhaust system, including an oxygen concentration sensor arranged in said exhaust system, said oxygen concentration sensor having an output characteristic that an output thereof is substantially proportional to concentration of oxygen present in exhaust gases from said engine, and feedback control means responsive to the output of said oxygen concentration sensor, for carrying out feedback control of an air-fuel ratio of a mixture supplied to said engine so as to make the air-fuel ratio equal to a desired air-fuel ratio, the improvement comprising:

activated state-detecting means for detecting an activated state of said oxygen concentration sensor; and correction-limiting means for limiting correction of the air-fuel ratio of said mixture by said feedback control means, depending upon the activated state of said oxygen concentration sensor detected by said activated state-detecting means, wherein said activated state-detecting means comprises internal resistance-detecting means for detecting internal resistance of said oxygen concentration sensor, said correction-limiting means sets (a) lower limit value of an amount of correction of the air-fuel ratio of said mixture to a larger value and/or (b) an upper limit value of the amount of correction of the air-fuel ratio of said mixture to a smaller value when the internal resistance of said oxygen concentration sensor detected by said internal resistance-detecting means is higher than a value of said internal resistance to be assumed when said oxygen concentration sensor has a temperature thereof falling in a predetermined activation temperature range within which said oxygen concentration sensor can be activated.

2. In an air fuel ratio control system for an internal combustion engine having an exhaust system, including an oxygen concentration sensor arranged in said exhaust system, said oxygen concentration sensor having an output characteristic that an output thereof is substantially proportional to concentration of oxygen present in exhaust gases from said engine, and feedback control means responsive to the output of said oxygen concentration sensor, for carrying out feedback control of an air-fuel ratio of a mixture supplied to said engine so as to make the air-fuel ratio equal to a desired air-fuel ratio, the improvement comprising:

activated state-detecting means for detecting an activated state of said oxygen concentration sensor; and correction-limiting means for limiting correction of the air-fuel ratio of said mixture by said feedback control means, depending upon the activated state of said oxygen concentration sensor detected by said activated state-detecting means, wherein said activated state-detecting means comprises internal resistance-detecting means for detecting internal resistance of said oxygen concentration sensor, said correction-limiting means sets a feedback gain applied to said feedback control to a smaller value when the internal resistance of said oxygen concentration sensor detected by said internal resistance-detecting means is higher than a value of said internal resistance to be assumed when said oxygen concentration sensor has a temperature thereof falling in a predetermined activation temperature range within which said oxygen concentration sensor can be activated.

3. In an air fuel ratio control system for an internal combustion engine having an exhaust system, including an oxygen concentration sensor arranged in said exhaust system, said oxygen concentration sensor having an output characteristic that an output thereof is substantially proportional to concentration of oxygen present in exhaust gases from said engine, and feedback control means responsive to the output of said oxygen concentration sensor, for carrying out feedback control of an air-fuel ratio of a mixture supplied to said engine so as to make the air-fuel ratio equal to a desired air-fuel ratio, the improvement comprising:

activated state-detecting means for detecting an activated state of said oxygen concentration sensor; and correction-limiting means for limiting correction of the air-fuel ratio of said mixture by said feedback control means, depending upon the activated state of said oxygen concentration sensor detected by said activated state-detecting means, wherein said activated state-detecting means comprises internal resistance-detecting means for detecting internal resistance of said oxygen concentration sensor, said feedback control means calculates an amount of correction of the air-fuel ratio of said mixture in response to a difference between a detected air-fuel ratio obtained from the output from said oxygen concentration sensor and said desired air-fuel ratio, said correction-limiting means limiting said difference within a predetermined range when the internal resistance of said oxygen concentration sensor detected by said internal resistance-detecting means is higher than a value of said internal resistance to be assumed when said oxygen concentration sensor has a temperature thereof falling in a predetermined activation temperature range within which said oxygen concentration sensor can be activated.

4. In an air-fuel ratio control system for an internal combustion engine having an exhaust system, including an oxygen concentration sensor arranged in said exhaust system, said oxygen concentration sensor having an output characteristic that an output thereof is substantially proportional to concentration of oxygen present in exhaust gases from said engine, feedback control means responsive to the output of said oxygen concentration sensor, for carrying out feedback control of an air-fuel ratio of a mixture supplied to said engine so as to make the air-fuel ratio of said mixture equal to a desired air-fuel ratio by calculating an air-fuel ratio correction coefficient, adaptive control means for carrying out adaptive control of the air-fuel ratio of said mixture so as to make the air-fuel ratio of said mixture equal to said desired air-fuel ratio by calculating an adaptive correction coefficient, and selecting means for selecting one of said feedback control means and said adaptive control means and applying a corresponding one of said air-fuel ratio correction coefficient and said adaptive correction coefficient to the selected one of said feedback control means and said adaptive control means as a feedback correction coefficient for correcting the air-fuel ratio of said mixture, the improvement comprising:

activated state-detecting means for detecting an activated state of said oxygen concentration sensor; and inhibiting means for inhibiting said adaptive control means from being selected by said selecting means, depending upon a value of said feedback correction coefficient and the activated state of said oxygen concentration sensor detected by said activated state-detecting means.

5. An air-fuel ratio control system as claimed in claim 4, wherein said inhibiting means inhibits said adaptive control means from being selected when said feedback correction coefficient has a value thereof falling outside a predetermined range and at the same time said oxygen concentration sensor is not in an activated state.

6. An air-fuel ratio control system as claimed in claim 4, including a correction coefficient-limiting means for limiting a range of the value of said feedback correction coefficient, depending upon the activated state of said oxygen concentration sensor detected by said activated state-detecting means.

7. An air-fuel ratio control system as claimed in claim 5, wherein said activated state-detecting means comprises internal resistance-detecting means for detecting internal resistance of said oxygen concentration sensor.

8. An air-fuel ratio control system as claimed in claim 7, wherein said correction coefficient-limiting means sets a lower limit value of an amount of correction of the air-fuel ratio of said mixture to a larger value when the internal resistance of said oxygen concentration sensor detected by said internal resistance-detecting means is higher than a value of said internal resistance to be assumed when said oxygen concentration sensor has a temperature thereof falling in a predetermined activation temperature range within which said oxygen concentration sensor can be activated.

9. An air-fuel ratio control system as claimed in claim 7 or 8, wherein said correction coefficient-limiting means sets an upper limit value of an amount of correction of the air-fuel ratio of said mixture to a smaller value when the internal resistance of said oxygen concentration sensor detected by said internal resistance-detecting means is higher than a value of said internal resistance to be assumed when said oxygen concentration sensor has a temperature thereof falling in a predetermined activation temperature range within which said oxygen concentration sensor can be activated.

* * * * *